US010925358B1

(12) United States Patent
Shawhan et al.

(10) Patent No.: US 10,925,358 B1
(45) Date of Patent: Feb. 23, 2021

(54) ARTIFICIAL JEWEL WITH INTERNAL LIGHT SOURCE FOR SKIN BODY ART

(71) Applicant: Amanda Shawhan, Los Angeles, CA (US)

(72) Inventors: Amanda Shawhan, Los Angeles, CA (US); Shaun Wada, Los Angeles, CA (US)

(73) Assignee: Amanda Shawhan, Los Angeles, CA (US)

( * ) Notice: Subject to any disclaimer, the term of this patent is extended or adjusted under 35 U.S.C. 154(b) by 0 days.

(21) Appl. No.: 16/874,583

(22) Filed: May 14, 2020

(51) Int. Cl.

| | |
|---|---|
| ***A44C 15/00*** | (2006.01) |
| ***F21S 9/02*** | (2006.01) |
| ***F21V 33/00*** | (2006.01) |
| ***F21W 121/06*** | (2006.01) |
| ***F21V 23/04*** | (2006.01) |

(52) U.S. Cl.
CPC ..... *A44C 15/0005* (2013.01); *A44C 15/0015* (2013.01); *F21S 9/02* (2013.01); *F21V 23/0414* (2013.01); *F21V 33/0004* (2013.01); *F21V 33/0008* (2013.01); *F21W 2121/06* (2013.01)

(58) Field of Classification Search
CPC ..... A44C 15/0005; A44C 15/0015; F21V 33/0008; F21V 33/0004; F21V 23/0414; F21V 23/04; A45C 15/06; F21W 2121/06; F21S 9/02
See application file for complete search history.

(56) References Cited

U.S. PATENT DOCUMENTS

| | | | |
|---|---|---|---|
| 2,270,270 | A | 1/1942 | Clare |
| 2,447,407 | A | 8/1948 | Grain |

(Continued)

FOREIGN PATENT DOCUMENTS

| | | | |
|---|---|---|---|
| GB | 2380251 | A | 4/2003 |
| WO | WO2007051323 | A1 | 5/2007 |

(Continued)

OTHER PUBLICATIONS

See concurrently provided and filed NPL file with a file name of "NPL" and dated Mar. 26, 2020, prepared by Applicant's patent attorney Eric Kelly.

(Continued)

*Primary Examiner* — Bryon T Gyllstrom
*Assistant Examiner* — James M Endo
(74) *Attorney, Agent, or Firm* — Eric Kelly

(57) ABSTRACT

An artificial jewel with internal light source may be configured for removable attachment to a region of human skin. The artificial jewel with internal light source may be assembled from a shell, a base-plate, and an electronics-assembly. A portion of the electronics-assembly may be disposed between an inside surface of the shell and an inside surface of the base-plate. The electronics-assembly may include at least one light source that may reside between the shell and the base-plate. The electronics-assembly may include a push button that may extend out beyond a bottom of the base-plate. A bottom of the base-plate may have a sticky adhesive layer for removable attachment to the region of human skin. An exterior surface of the shell may be faceted. The shell may be optically transparent. A distal portion of the push button may physically touch the region of human skin.

21 Claims, 23 Drawing Sheets

(56) References Cited

U.S. PATENT DOCUMENTS 4,093,973 A * 6/1978 Vaagenes ..... A44C 15/0015 362/104
4,096,552 A 6/1978 Ben-Porat
4,220,016 A * 9/1980 Frenger ..... A44C 15/0005 63/14.9
4,295,347 A 10/1981 Visconti
4,604,876 A 8/1986 Hoffman
4,635,167 A * 1/1987 Schlosser ..... H01H 13/023 200/314
4,942,744 A 7/1990 Wei
4,998,186 A 3/1991 Cocca
5,018,053 A 5/1991 Belknap
5,117,338 A 5/1992 McCrary
5,323,300 A 6/1994 McCrary
5,477,433 A 12/1995 Ohlund
6,174,075 B1 * 1/2001 Fuwausa ..... A41D 27/085 362/103
6,288,498 B1 * 9/2001 Cheng ..... A44C 15/0015 315/185 S
6,420,008 B1 * 7/2002 Lewis ..... A44C 15/0015 156/250
6,433,483 B1 8/2002 Michael
6,833,539 B1 * 12/2004 Maeda ..... A44C 15/0015 250/214 AL
7,165,859 B1 * 1/2007 Munari ..... F21L 4/00 362/103
7,367,684 B2 5/2008 D'Souza
2002/0109596 A1 * 8/2002 Phillips ..... G08B 1/08 340/573.1
2004/0032734 A1 * 2/2004 Chen ..... A42B 1/242 362/189
2004/0136179 A1 7/2004 Lewis
2004/0212987 A1 * 10/2004 Lu ..... B43K 23/001 362/101
2005/0243560 A1 11/2005 Chen
2006/0133066 A1 6/2006 D'Souza
2007/0236928 A1 10/2007 Hsu
2009/0091922 A1 * 4/2009 Yang ..... A42B 1/244 362/103
2010/0043491 A1 * 2/2010 Rossi ..... G06K 19/07749 63/1.13
2013/0271964 A1 * 10/2013 Rife ..... A44C 15/0015 362/104
2015/0009654 A1 * 1/2015 Chan ..... F21S 9/02 362/104
2015/0075217 A1 3/2015 Disinger
2017/0229596 A1 8/2017 Mair
2018/0033919 A1 2/2018 Lee
2019/0008242 A1 1/2019 Gapp

FOREIGN PATENT DOCUMENTS

WO WO2010075599 A1 7/2010
WO WO2017149375 A1 9/2017

OTHER PUBLICATIONS

See Hannah Ovenden's "Festival Face Group" light up face jewerly; see e.g., https://www.wekoko.com/marketplace/seller/profile/festivalfaces and https://www.facebook.com/festivalfacesgroup/.

* cited by examiner

ARTIFICIAL JEWEL WITH INTERNAL LIGHT SOURCE FOR SKIN BODY ART

TECHNICAL FIELD OF THE INVENTION

The present invention relates in general to body art jewelry that is removably attached to skin and more specifically to artificial jewels with an internal light source that is removably attachable to skin for light up body art.

COPYRIGHT AND TRADEMARK NOTICE

A portion of the disclosure of this patent application may contain material that is subject to copyright protection. The owner has no objection to the facsimile reproduction by anyone of the patent document or the patent disclosure, as it appears in the Patent and Trademark Office patent file or records, but otherwise reserves all copyrights whatsoever.

Certain marks referenced herein may be common law or registered trademarks of third parties affiliated or unaffiliated with the applicant or the assignee. Use of these marks is by way of example and should not be construed as descriptive or to limit the scope of this invention to material associated only with such marks.

BACKGROUND OF THE INVENTION

Presently (circa 2019) people may use artificial jewels (such as, but not limited to, costume jewelry and/or rhinestone jewelry) with adhesive backings to stick onto human skin to create body art. Such stick-on artificial jewels may be arranged on the face (e.g., the forehead) and/or chest as common examples. Such stick-on artificial jewels, as body art, are common at festivals, fairs, amusement parks, parties, performances, concerts, social outings, social events, and/or the like.

It would be desirable if such stick-on artificial jewels, as body art, could emit generated light, in various colors and/or light emission patterns.

Festival Faces Group (e.g., www.festivalfacesgroup.com) is providing and has provided a light up artificial jewel, with an adhesive backing, intended to be stuck onto human skin. See e.g., FIG. 1A through FIG. 1G (which are all prior art), which are intended to be drawings that show a light up artificial jewel provided by Festival Faces Group. The light up artificial jewel 100 provided by Festival Faces Group shown in FIG. 1A through FIG. 1G appears to be an assembly of two main components, a preexisting artificial jewel 101 and a circuitry layer 103. See e.g., FIG. 1C through FIG. 1G. The preexisting artificial jewel 101 appears to be a standard off the shelf preexisting artificial jewel, that is entirely solid and without any components, including electronics, inside of this standard off the shelf preexisting artificial jewel 101. The preexisting artificial jewel 101 is entirely made out of a plastic. Below this preexisting artificial jewel 101 and attached to the preexisting artificial jewel 101 is the circuitry layer 103. See e.g., FIG. 1C through FIG. 1G. The exterior of this circuitry layer 103 is covered in a rhinestone lace 105, that is three small rhinestones high around the rhinestone lace 105. See e.g., FIG. 1C through FIG. 1G. A bottom of circuitry layer 103 has a tacky adhesive for sticking onto a region of human skin, provided by a thin, flexible, and transparent planar member. From an exterior side of the circuitry layer 103, below the preexisting artificial jewel 101, is a finger toggle switch 107. See e.g., FIG. 1C, FIG. 1E, and FIG. 1G. The exterior portions of the overall switch, switch 107 is connected to internal portions of the overall switch, switch 108. See e.g., FIG. 1G. Switch 108 is connected to a wire 109 that is connected to a battery 111, then battery 111 is connected to wires 105, and then wires 105 are connected to a light 115. See e.g., FIG. 1G. Switch 107/108 are disposed at one end of 103, disposed opposite from battery 111 at the other end of 103, separated by wire 109. See e.g., FIG. 1G. Light 115 is disposed between switch 107/108 and battery 111 in 103. See e.g., FIG. 1G. Light 115 and battery 111 are proximate to (next to) different sides of circuitry layer 103. See e.g., FIG. 1G. Light 115 is below preexisting artificial jewel 101. See e.g., FIG. 1G. Light 115 faces wire 109. Switch 107/108, wire 109, battery 111, wires 113, and light 115 are all part of circuitry layer 103 and are all below preexisting artificial jewel 101. See e.g., FIG. 1G.

However, in use there are several problems with light up artificial jewel 100. First, light up artificial jewel 100 is too heavy for its intended use. Because of being too heavy, light up artificial jewel 100 is very prone to falling off of human skin prematurely (e.g., falling off within 15 minutes or less). The excessive heaviness of light up artificial jewel 100 is a product of design flaws in light up artificial jewel 100. Preexisting artificial jewel 101 is solid and does not contain any of the circuitry. Weight could have been minimized by placing the electronics within the artificial jewel and not below the artificial jewel in a separate layer. Additionally, all of the circuitry elements (e.g., switch 107/108, wire 109, battery 111, wires 113, and light 115) of circuitry layer 103 are dispersed and non-integrated within circuitry layer 103, which makes 103 heavier than necessary. It would be desirable to minimize weight by entirely eliminating circuitry layer 103 by placing all the electronics within the artificial jewel. It would be desirable to minimize weight by implementing the circuitry/electronics via an integrated and/or printed circuit board (PCB), which would be smaller and lighter than the circuitry elements of circuitry layer 103. An integrated and/or printed circuit board (PCB) would also likely be more energy efficient over the arrangement of circuitry layer 103.

Second, light up artificial jewel 100 is too high (thick) for its intended use. The profile (height and/or thickness) of light up artificial jewel 100 from the bottom of circuitry layer 103 to the top of preexisting artificial jewel 101 is undesirably too high/thick. This too high/thick profile stems from preexisting artificial jewel 101 being attached on top of circuitry layer 103, i.e., in this two layers on top of each other configuration. For example, if the electronics were placed within the artificial jewel instead of below, then circuitry layer 103 could be eliminated and the overall height/thickness of the light up artificial jewel could be reduced by about half or at least half. The problem with an artificial jewel having a profile that is too high/thick, is that when the artificial jewel is stuck onto the region of human skin, the higher/thicker its profile, the more likely the artificial jewel is to catch on some object in the environment and be knocked off of that region of human skin. Thus, a lower profile would minimize unintended impacts between the stick-on artificial jewel (that is stuck onto a region of human skin) and the environment.

Third, light 115 in circuitry layer 103 not located in an optimal position with respect to preexisting artificial jewel 101. Light 115 is oriented towards (pointing at) wire 109 that is disposed opposite of light 115. Light 115 is not located centrally within preexisting artificial jewel 101 nor centrally within circuitry layer 103. It would have been desirable to locate the light centrally within the circuitry layer 103 or even better, to locate the light within the artificial jewel to optimize light emission from the artificial jewel.

Fourth, there are problems with both the type of switch 107 used and the location of switch 107. As noted, switch 107 is located on an exterior side of light up artificial jewel 100, specifically on a side of the circuitry layer 103. Switch 107 is a finger toggle switch, that slides back and forth between an off position and an on position. The direction of sliding back and forth is substantially along the length of light up artificial jewel 100. When light up artificial jewel 100 is attached to a region of human skin, because of switch 107's location on the side of circuitry layer 103, it is difficult, with a finger, to engage switch 107 without knocking light up artificial jewel 100 off of the region of human skin. Additionally, because the direction of engagement of switch 107 is back and forth along the length of light up artificial jewel 100, engaging switch 107 when light up artificial jewel 100 is attached to the region of human skin tends to knock light up artificial jewel 100 off of that region of human skin because the direction (vector) of switch 107 engagement is substantially orthogonal to the adhesive backing, i.e., toggling switch 107 introduces an undesired and unnecessary shear force to the adhesive backing of light up artificial jewel 100. It would be desirable if the means for controlling the light up artificial jewel, including its location, was compatible with the light up artificial jewel being removable attachable to a region of human skin.

There is a need in the art for artificial jewel with internal light source for removable attachment to a region of human skin, that is: (1) lighter than prior art products; (2) has a slimmer profile than prior art products; (3) has a light source that is internal to the artificial jewel; and (4) wherein the means for controlling the artificial jewel with internal light source, including its location, is compatible with the artificial jewel with internal light source being removably attachable to the region of human skin.

It is to these ends that the present invention has been developed.

BRIEF SUMMARY OF THE INVENTION

To minimize the limitations in the prior art, and to minimize other limitations that will be apparent upon reading and understanding the present specification, the present invention may describe an artificial-jewel-with-internal-light-source configured for removable attachment to a region of human skin.

In some embodiments, the artificial-jewel-with-internal-light-source may comprise: a shell, a base-plate, and an electronics-assembly. In some embodiments, the shell may have an exterior-surface that may be shaped and sized to mimic a crown of a predetermined type of cut gemstone, such as, but not limited to, a marquise type (other types are expressly contemplated). In some embodiments, the shell may comprise a base around a bottom edge of the shell. In some embodiments, the exterior-surface of the shell may be faceted. In some embodiments, at least a portion of the shell may be optically transparent. In some embodiments, the base-plate may be to the base of the shell. In some embodiments, the base-plate may have a bottom-surface that may face away from the shell. In some embodiments, at least a portion of the bottom-surface of the base-plate may comprise a sticky-adhesive-layer that may be configured to removably stick to the region of human skin. In some embodiments, the electronics-assembly may comprise at least one light-portion that may be configured to emit light. In some embodiments, part (at least part of) of the electronics-assembly may be disposed between an inside-surface of the shell and an inside-surface of the base-plate. In some embodiments, the inside-surface of the base-plate may be an opposing surface to the bottom-surface of the base-plate.

In some embodiments, the electronics-assembly may include a push button that may extend out beyond a bottom of the base-plate. In some embodiments, a distal portion of the push button may physically touch the region of human skin. User (e.g., a wearer) control of light emission of the artificial-jewel-with-internal-light-source may occur by the user pressing the shell towards the region of the human skin that the artificial-jewel-with-internal-light-source may be removably attached to, which in turn may cause engagement of this push button that may be touching the region of the human skin.

In some embodiments, the electronics-assembly may include a push button that is located entirely within an interior of the shell, wherein this push button is engageable by hinge/pivot mechanics of pushing the shell towards the base-plate.

It is an objective of the present invention to provide a gemstone that is both capable of being lit up by an internal light source and capable of being removably attached to a region of human skin.

It is another objective of the present invention to provide such a gemstone wherein that gemstone may be removably attached to the region of skin using a skin adhesive.

It is another objective of the present invention to provide such a gemstone wherein that gemstone may be artificial.

It is another objective of the present invention to provide such a gemstone wherein an exterior-surface of that gemstone may be shaped and sized to mimic a crown of a predetermined type of cut gemstone.

It is another objective of the present invention to provide such a gemstone wherein that gemstone may be light weight to minimize unintentional falling off from the region of human skin.

It is another objective of the present invention to provide such a gemstone wherein that gemstone may have a slim profile (minimal height) to minimize unintentional falling off from the region of human skin.

It is another objective of the present invention to provide such a gemstone wherein the at least one light source of the gemstone may emit light in different colors and/or in different light emission patterns.

It is another objective of the present invention to provide such a gemstone wherein a location of the at least one light source of the gemstone may be positioned/located within the gemstone to optimize and/or maximize brilliance of emitted light from a crown of that gemstone.

It is another objective of the present invention to provide such a gemstone wherein that gemstone may have a button extending from a flat bottom of that gemstone.

It is another objective of the present invention to provide a such a gemstone wherein that gemstone may have a button located entirely within an interior of the shell of that gemstone, wherein this push button is engageable by hinge/pivot mechanics of pushing the shell towards a base-plate of that gemstone.

It is another objective of the present invention to provide such a gemstone wherein a means for controlling and/or actuating the at least one light source of the gemstone does not impart an undesired shear stress to the gemstone when the gemstone may be removably attached to the region of the human skin.

It is yet another objective of the present invention to provide such a gemstone wherein a means for controlling and/or actuating the at least one light source of the gemstone occurs by the user (e.g., wearer) merely pushing the gemstone against the region of skin that the gemstone may be removably attached to.

These and other advantages and features of the present invention are described herein with specificity so as to make the present invention understandable to one of ordinary skill in the art, both with respect to how to practice the present invention and how to make the present invention.

BRIEF DESCRIPTION OF THE SEVERAL VIEWS OF THE DRAWINGS

Elements in the figures have not necessarily been drawn to scale in order to enhance their clarity and improve understanding of these various elements and embodiments of the invention. Furthermore, elements that are known to be common and well understood to those in the industry are not depicted in order to provide a clear view of the various embodiments of the invention.

(FIG. 1C and FIG. 1D may be opposing views.)

(FIG. 1E and FIG. 1F may be opposing views.)

FIG. 2C and FIG. 2D may be substantially orthogonal with respect to each other.

FIG. 3A may depict be a bottom perspective exploded view of an artificial-jewel-with-internal-light-source.

FIG. 4B may include sectional line 4C-4C through a lengthwise middle of the shell.

REFERENCE NUMERAL SCHEDULE

Figure 1A:
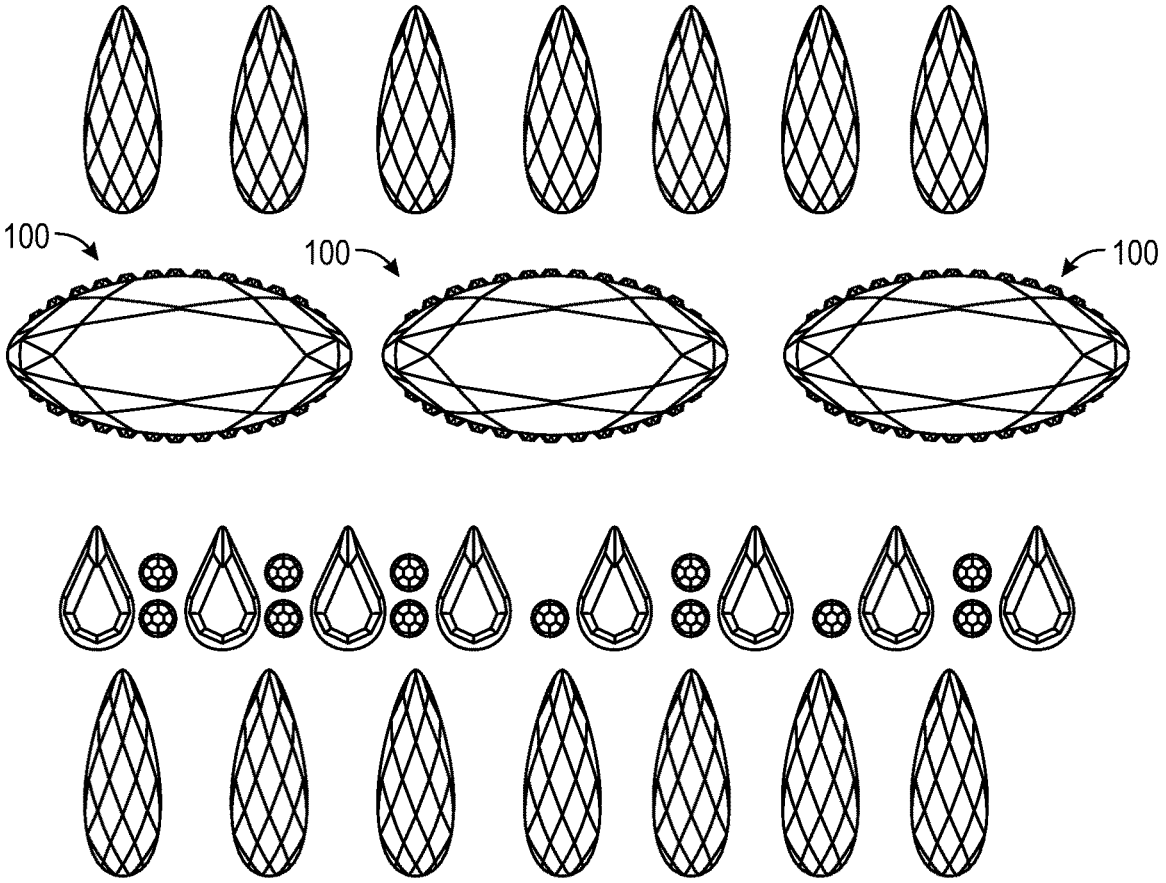
FIG. 1A (Prior Art)
FIG. 1A (prior art) may depict a group of stick on preexisting artificial jewels without light sources arranged around three larger preexisting artificial jewels that can light up.
Figure 1B:
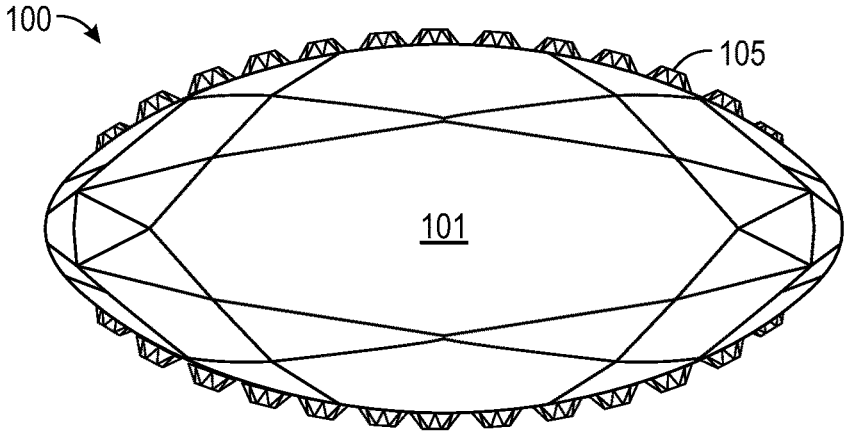
FIG. 1B (Prior Art)
FIG. 1B (prior art) may depict a top view of a preexisting artificial jewel that can light up.
Figure 1C:
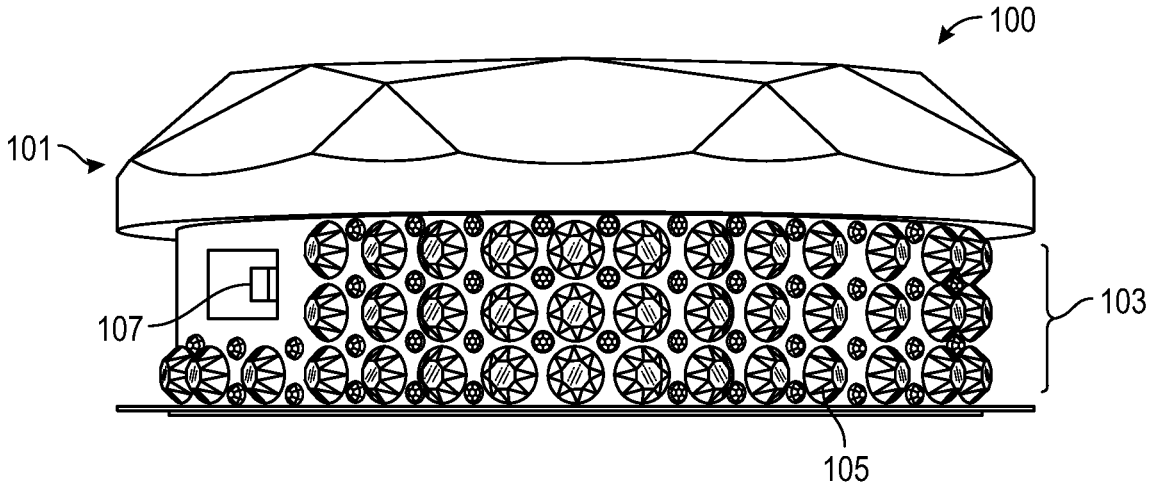
FIG. 1C (Prior Art)
FIG. 1C (prior art) may depict a lengthwise side view of a preexisting artificial jewel that can light up.
Figure 1D:
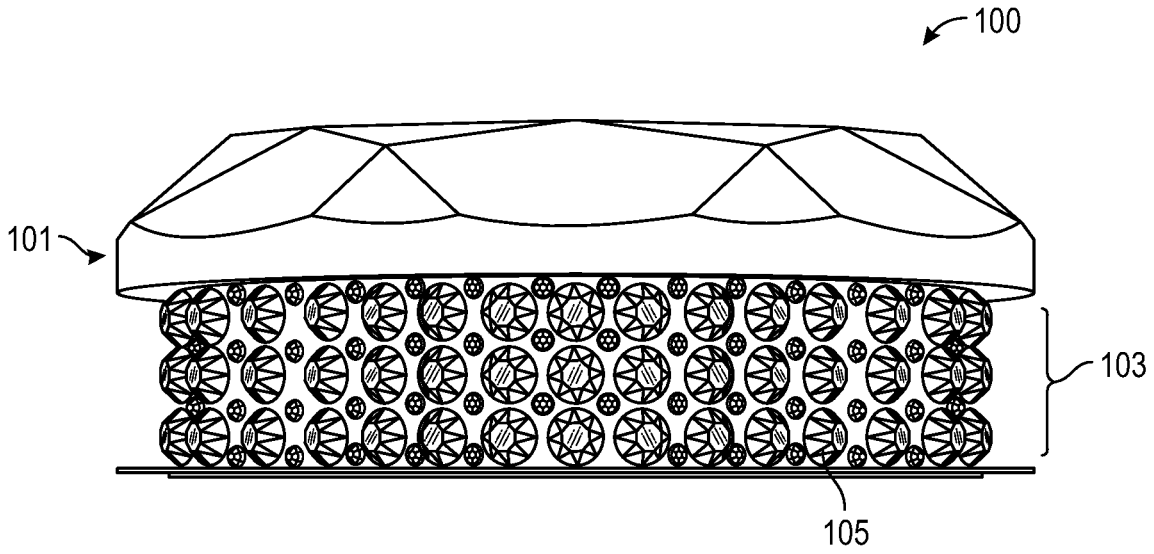
FIG. 1D (Prior Art)
FIG. 1D (prior art) may depict a lengthwise side view of a preexisting artificial jewel that can light up.
Figure 1E:
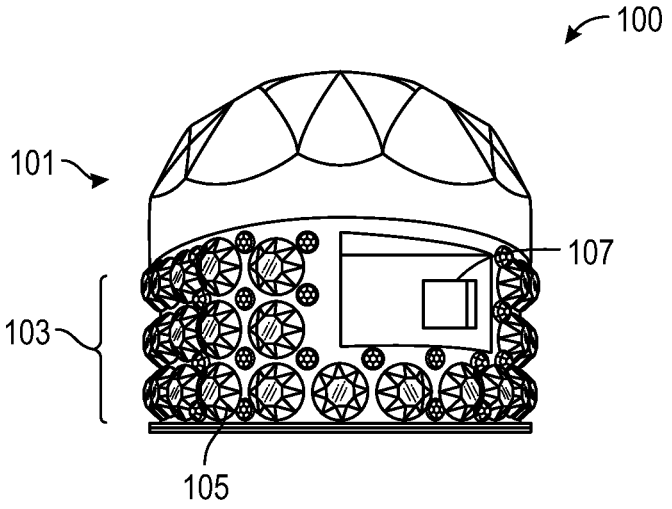
FIG. 1E (Prior Art)
FIG. 1E (prior art) may depict a transverse width side view of a preexisting artificial jewel that can light up.
Figure 1F:
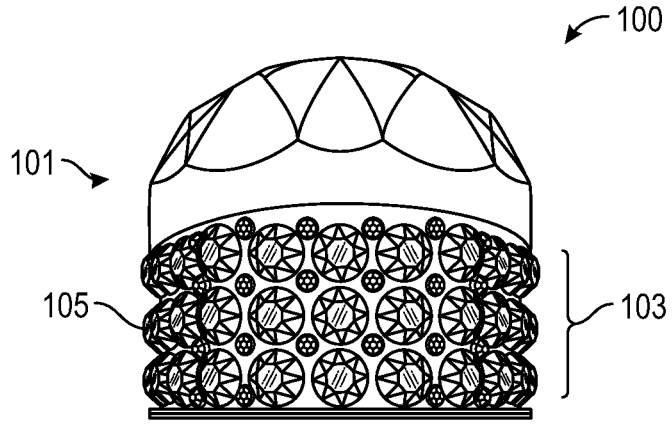
FIG. 1F (Prior Art)
FIG. 1F (prior art) may depict a transverse width side view of a preexisting artificial jewel that can light up.
Figure 1G:
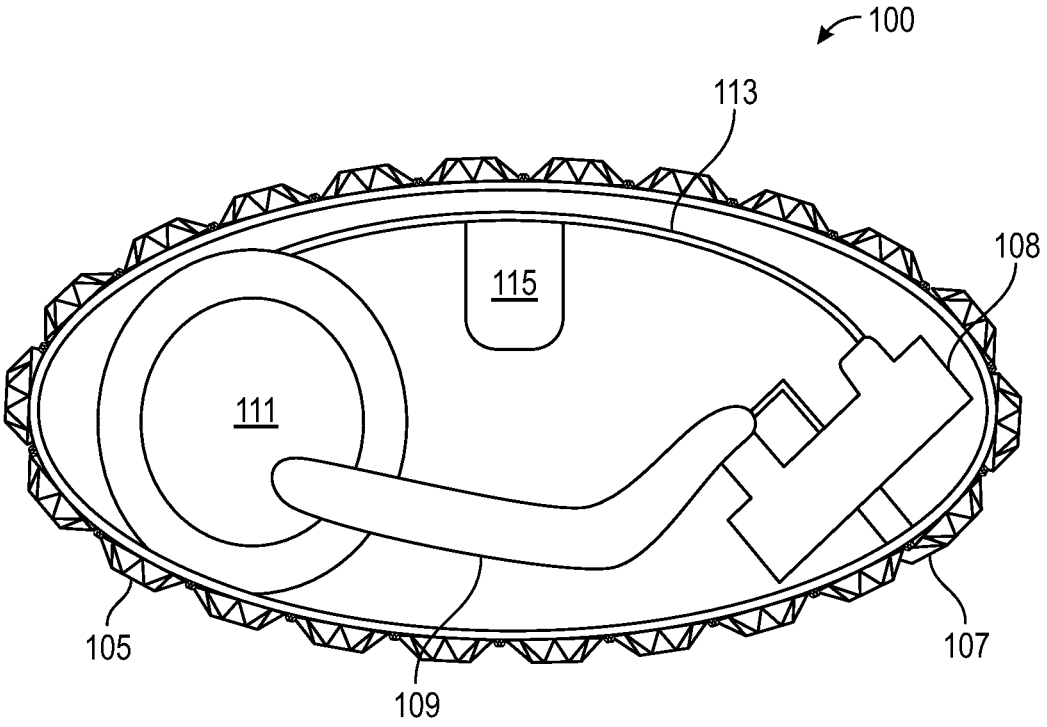
FIG. 1G (Prior Art)
FIG. 1G (prior art) may depict a bottom view of a preexisting artificial jewel that can light up.

100 light up artificial jewel 100
101 preexisting artificial jewel 101
103 circuitry layer 103
105 rhinestone lace 105
107 switch 107
108 switch 108
109 wire 109
111 battery 111
113 wires 113
115 light 115
200 artificial-jewel-with-internal-light-source 200
201 shell 201
203 base-plate 203
205 hole-for-button 205
207 notch 207
209 button 209
211 sticky adhesive layer 211
301 electronics-assembly 301
303 light-portion 303
305 power-source 305
307 integrated-circuit 307
307*a* microcontroller 307*a*
307*b* PCB (printed circuit board) 307*b*
400 exterior-surface 400
401 length 401
402 top-length 402
403 width 403
404 top-width 404

405 height 405
407 shell-thickness 407
409 base-to-inside-top 409
411 height 411 [of 1st facets from base]
413 height 413 [height to where second ring of facets end from base]
415 height 415 [of boundary to inset-relief 42]
417 length-of-inset-relief 417
419 base 419
421 facet 421
423 inside-surface 423
425 inset-relief 425
501 inside-surface 501
503 edge 503
505 bottom-surface 505
507 length 507
509 width 509
511 hole-distance 511
513 diameter 513
515 notch-width 515
517 notch-depth 517
519 thickness 519
700 artificial-jewel-with-internal-light-source 700
701 pivot-arms 701
703 up-down-arms 703
705 button-push-arm 705
707 pocket 707
711 pivot-stand 711
713 stand 713
715 ball/bar 715
717 ball/bar 717
721 pivot-end 721
731 up-down translation end 731

DETAILED DESCRIPTION OF THE INVENTION

In the following discussion that addresses a number of embodiments and applications of the present invention, reference is made to the accompanying drawings that form a part thereof, where depictions are made, by way of illustration, of specific embodiments in which the invention may be practiced. It is to be understood that other embodiments may be utilized and changes may be made without departing from the scope of the invention.

Note, this discussion of prior art shown in FIG. 1A through FIG. 1G is repeated in part from the Background of the Invention section above.

See e.g., FIG. 1A through FIG. 1G (which are all prior art), which are intended to be drawings that show a light up artificial jewel provided by Festival Faces Group. The light up artificial jewel 100 provided by Festival Faces Group shown in FIG. 1A through FIG. 1G appears to be an assembly of two main components, a preexisting artificial jewel 101 and a circuitry layer 103. See e.g., FIG. 1C through FIG. 1G. The preexisting artificial jewel 101 appears to be a standard off the shelf preexisting artificial jewel, that is entirely solid and without any components, including electronics, inside of this standard off the shelf preexisting artificial jewel 101. The preexisting artificial jewel 101 is entirely made out of a plastic. Below this preexisting artificial jewel 101 and attached to the preexisting artificial jewel 101 is the circuitry layer 103. See e.g., FIG. 1C through FIG. 1G. The exterior of this circuitry layer 103 is covered in a rhinestone lace 105, that is three small rhinestones high around the rhinestone lace 105. See e.g., FIG. 1C through FIG. 1G. A bottom of circuitry layer 103 has a tacky adhesive for sticking onto a region of human skin, provided by a thin, flexible, and transparent planar member. From an exterior side of the circuitry layer 103, below the preexisting artificial jewel 101, is a finger toggle switch 107. See e.g., FIG. 1C, FIG. 1E, and FIG. 1G. The exterior portions of the overall switch, switch 107 is connected to internal portions of the overall switch, switch 108. See e.g., FIG. 1G. Switch 108 is connected to a wire 109 that is connected to a battery 111, then battery 111 is connected to wires 105, and then wires 105 are connected to a light 115. See e.g., FIG. 1G. Switch 107/108 are disposed at one end of 103, disposed opposite from battery 111 at the other end of 103, separated by wire 109. See e.g., FIG. 1G. Light 115 is disposed between switch 107/108 and battery 111 in 103. See e.g., FIG. 1G. Light 115 and battery 111 are proximate to (next to) different sides of circuitry layer 103. See e.g., FIG. 1G. Light 115 is below preexisting artificial jewel 101. See e.g., FIG. 1G. Light 115 faces wire 109. Switch 107/108, wire 109, battery 111, wires 113, and light 115 are all part of circuitry layer 103 and are all below preexisting artificial jewel 101. See e.g., FIG. 1G.

Figure 2C:
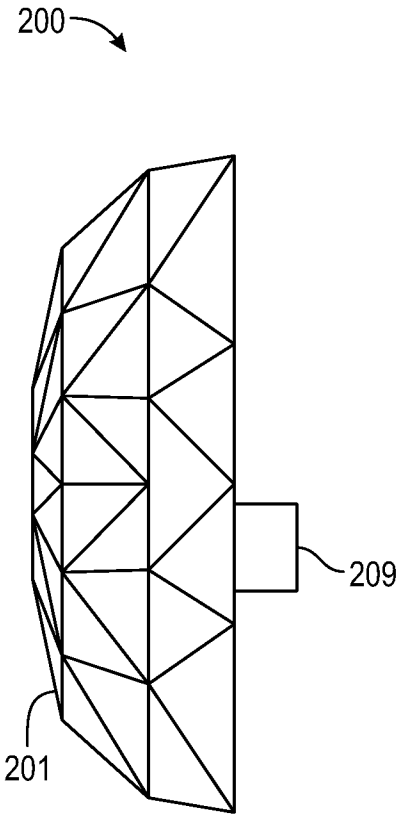
FIG. 2C may depict a longitudinal (lengthwise) side view of an artificial-jewel-with-internal-light-source.
Figure 2B:
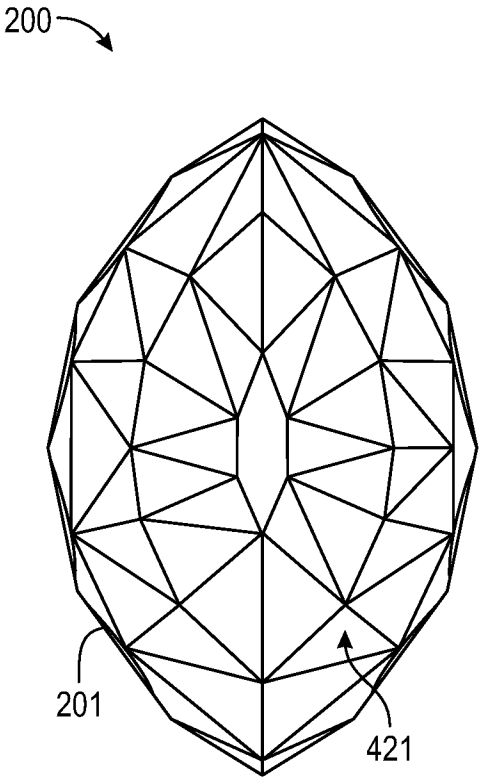
FIG. 2B may depict a top view of an artificial-jewel-with-internal-light-source, showing just exterior portions of a shell which shows as a crown of the artificial-jewel-with-internal-light-source.
Figure 2A:
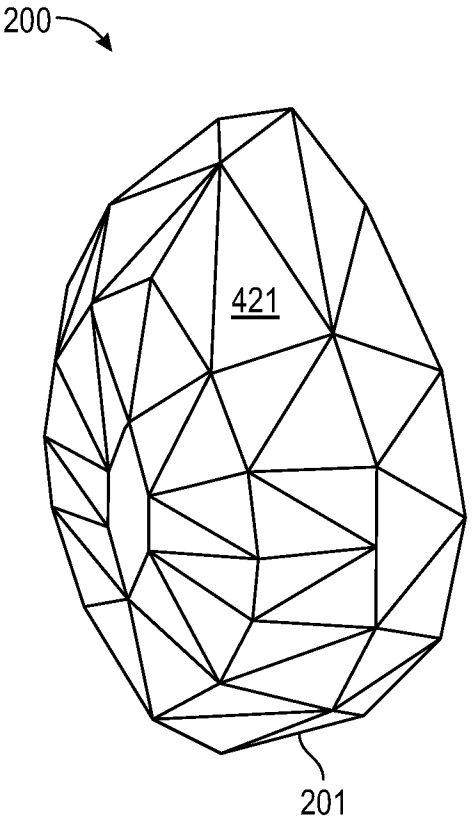
FIG. 2A may depict a top perspective of an artificial-jewel-with-internal-light-source according to at least one embodiment of the present invention.
Figure 2D:
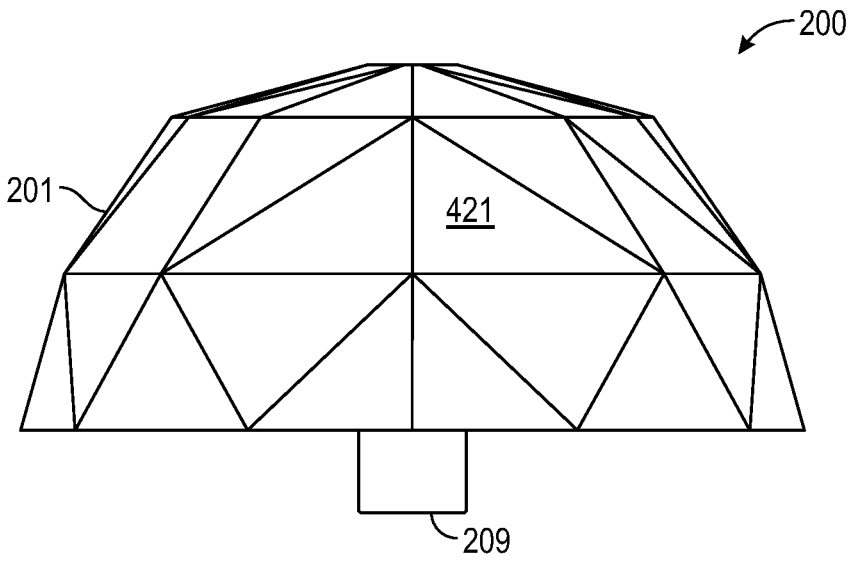
FIG. 2D may depict a transverse width side view of an artificial-jewel-with-internal-light-source.
Figure 2E:
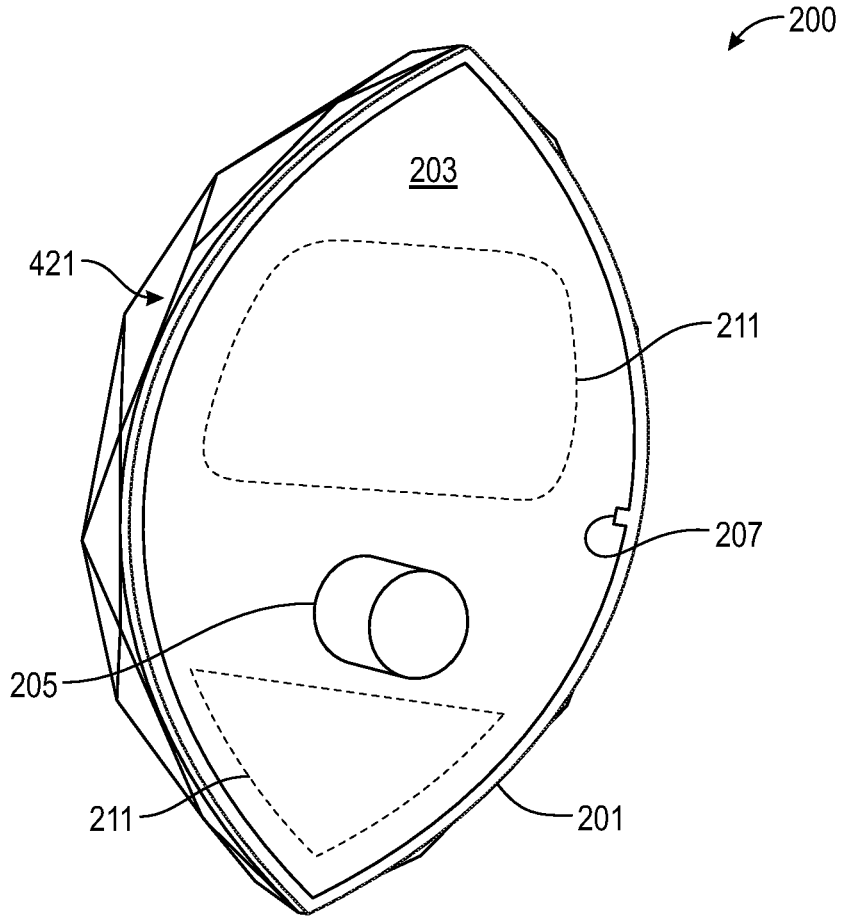
FIG. 2E may depict a bottom perspective view of an artificial-jewel-with-internal-light-source.
Figure 2F:
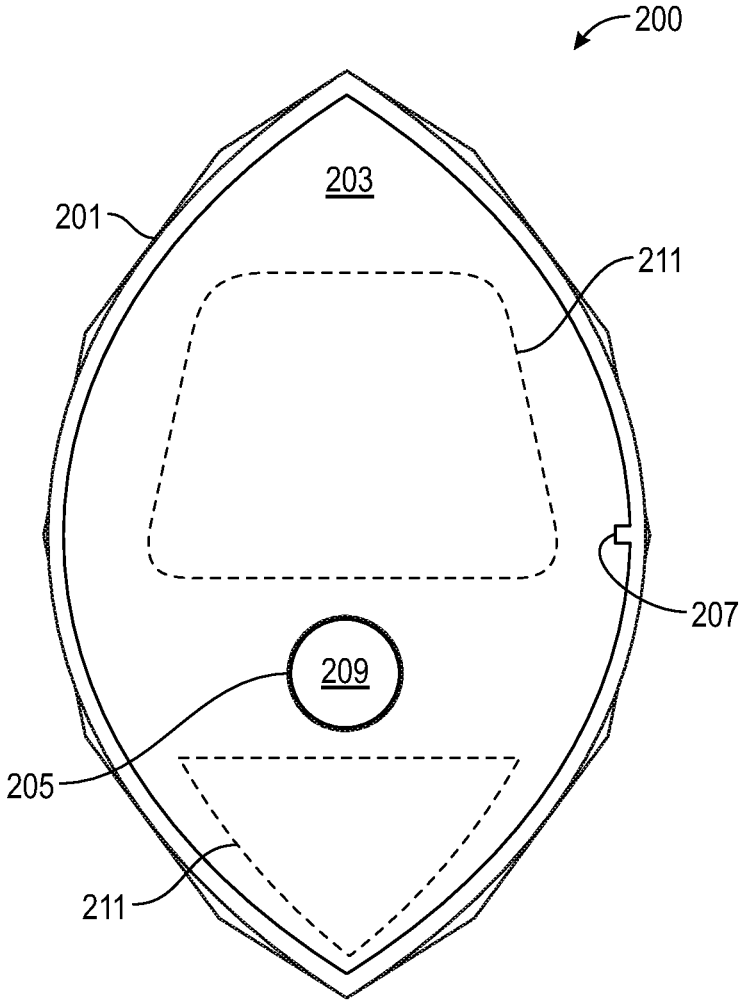
FIG. 2F may depict a bottom view of an artificial-jewel-with-internal-light-source, showing a bottom and an exterior surface of a base-plate.

FIG. 2A may depict a top perspective of a given artificial-jewel-with-internal-light-source 200. In FIG. 2A a portion of shell 201 and a portion of base-plate 203, components of artificial-jewel-with-internal-light-source 200, may be seen. FIG. 2B may depict a top view of artificial-jewel-with-internal-light-source 200, showing just exterior portions of shell 201. FIG. 2C may depict a longitudinal (lengthwise) side view of artificial-jewel-with-internal-light-source 200. FIG. 2D may depict a transverse width side view of artificial-jewel-with-internal-light-source 200. FIG. 2C and FIG. 2D may be substantially orthogonal with respect to each other. FIG. 2E may depict a bottom perspective view of artificial-jewel-with-internal-light-source 200. FIG. 2F may depict a bottom view of artificial-jewel-with-internal-light-source 200, showing a bottom and an exterior surface of base-plate 203.

Continuing discussing FIG. 2A through FIG. 2F, in some embodiments, a given artificial-jewel-with-internal-light-source 200 may comprise shell 201 and base-plate 203. In some embodiments, base-plate 203 may be attached to a bottom of shell 201. In some embodiments, shell 201 on its exterior may be shaped and/or sized to mimic a faceted jewel and/or a faceted cut gem. In some embodiments, shell 201 on its exterior may be shaped and/or sized as an artificial faceted jewel and/or as an artificial faceted cut gem. In some embodiments, shell 201 may be substantially concave and/or hollow on its inside. In some embodiments, shell 201 may house most (substantially all) of an electronics-assembly 301 (see e.g., FIG. 3A). In some embodiments, base-plate 203 may cover over an otherwise opening to the interior of shell 201, when base-plate 203 may be attached to the bottom of shell 201. In some embodiments, when base-plate 203 may be attached to the bottom of shell 201, substantially all of electronics-assembly 301 may be housed inside of shell 201, aside from portions of a button 209 which may be protruding out from base-plate 203.

Discussing FIG. 2F, in some embodiments, base-plate 203 may comprise at least one through hole, a hole-for-button 205. In some embodiments, hole-for-button 205 may be configured to receive at least a portion of button 209. In some embodiments, hole-for-button 205 may be shaped and/or sized to receive at least a portion of button 209. In some embodiments, button 209 may be a component of electronics-assembly 301. In some embodiments, a portion of button 209 may extend out from hole-for-button 205. In some embodiments, button 209 may be a substantially cylindrical member. In some embodiments, hole-for-button 205 and a diameter of button 209 may be substantially concentric with respect to each other, when base-plate 203 may be viewed from the bottom view, as in FIG. 2F. In some embodiments, hole-for-button 205 may be substantially circular. In some embodiments, hole-for-button 205 may be centered in base-plate 203, with respect to a transverse width of base-plate 203. In some embodiments, hole-for-button 205 may be off-center in base-plate 203, with respect to a longitude (length) of base-plate 203. In some embodiments, when button 209 may be engaged, at least a portion of button 209 may removably reside within shell 201.

Continuing discussing FIG. 2F, in some embodiments, at least a portion of the bottom and/or exterior of base-plate 203 may be covered in a sticky adhesive layer 211, that may be configured to removably stick to human skin. In some embodiments, base-plate 203 may comprise sticky adhesive layer 211. In some embodiments, sticky adhesive layer 211 may be formulated for removable attachment to a region of human skin (such as, but not limited to, face skin and/or chest skin). In some embodiments, this sticky adhesive layer 211 may be substantially hypoallergenic. In some embodiments, this sticky adhesive layer 211 may be a skin adhesive used in the cosmetics and makeup industries.

Continuing discussing FIG. 2F, in some embodiments, base-plate 203 may comprise at least one through hole, a notch 207. In some embodiments, along an outer edge of base-plate 203 may be at least one notch 207. In some embodiments, notch 207 may be an indenture into the outer edge of base-plate 203. In some embodiments, notch 207 may be a cutout into the outer edge of base-plate 203.

Figure 3A:
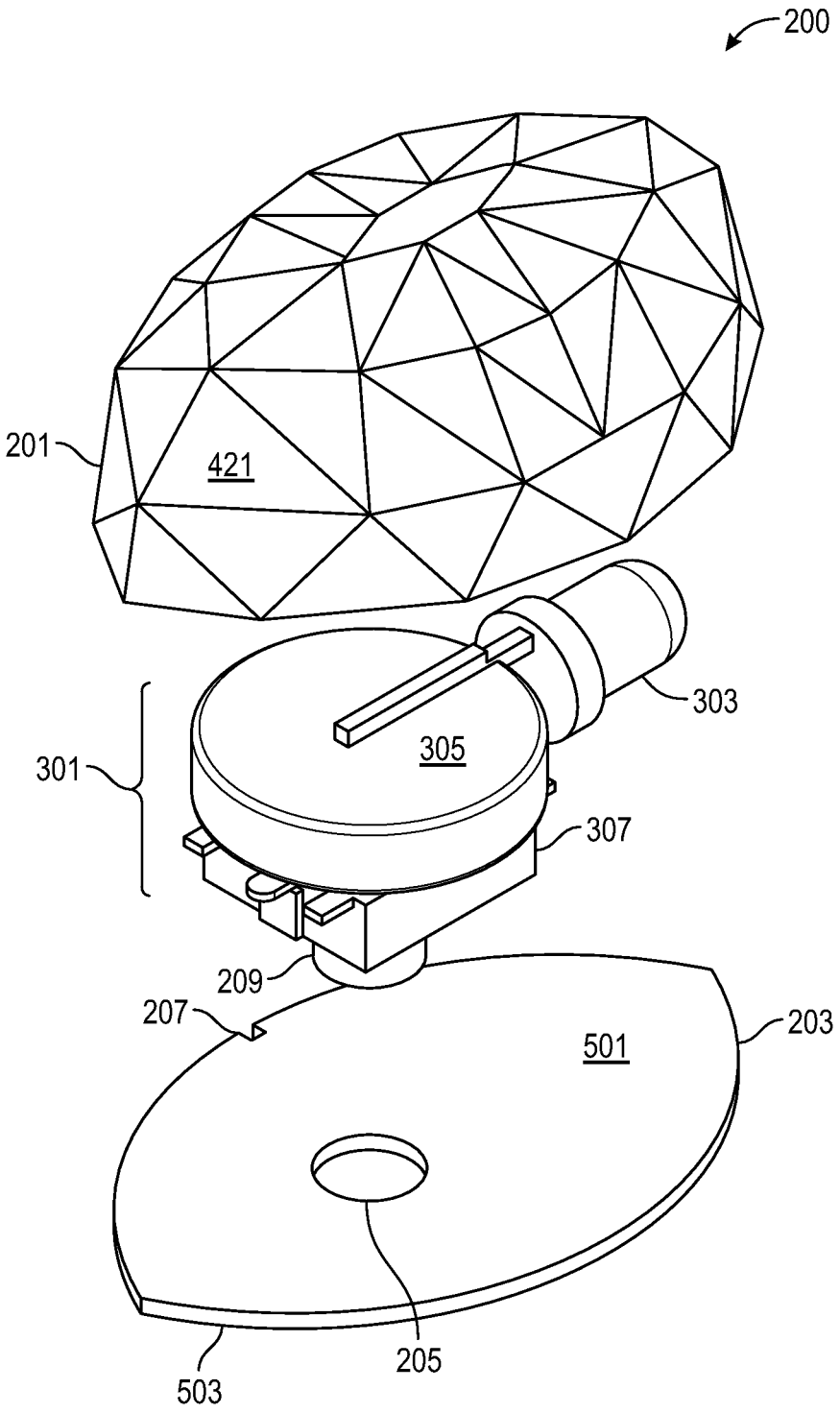
FIG. 3A may depict be a top perspective exploded view of an artificial-jewel-with-internal-light-source.
Figure 3B:
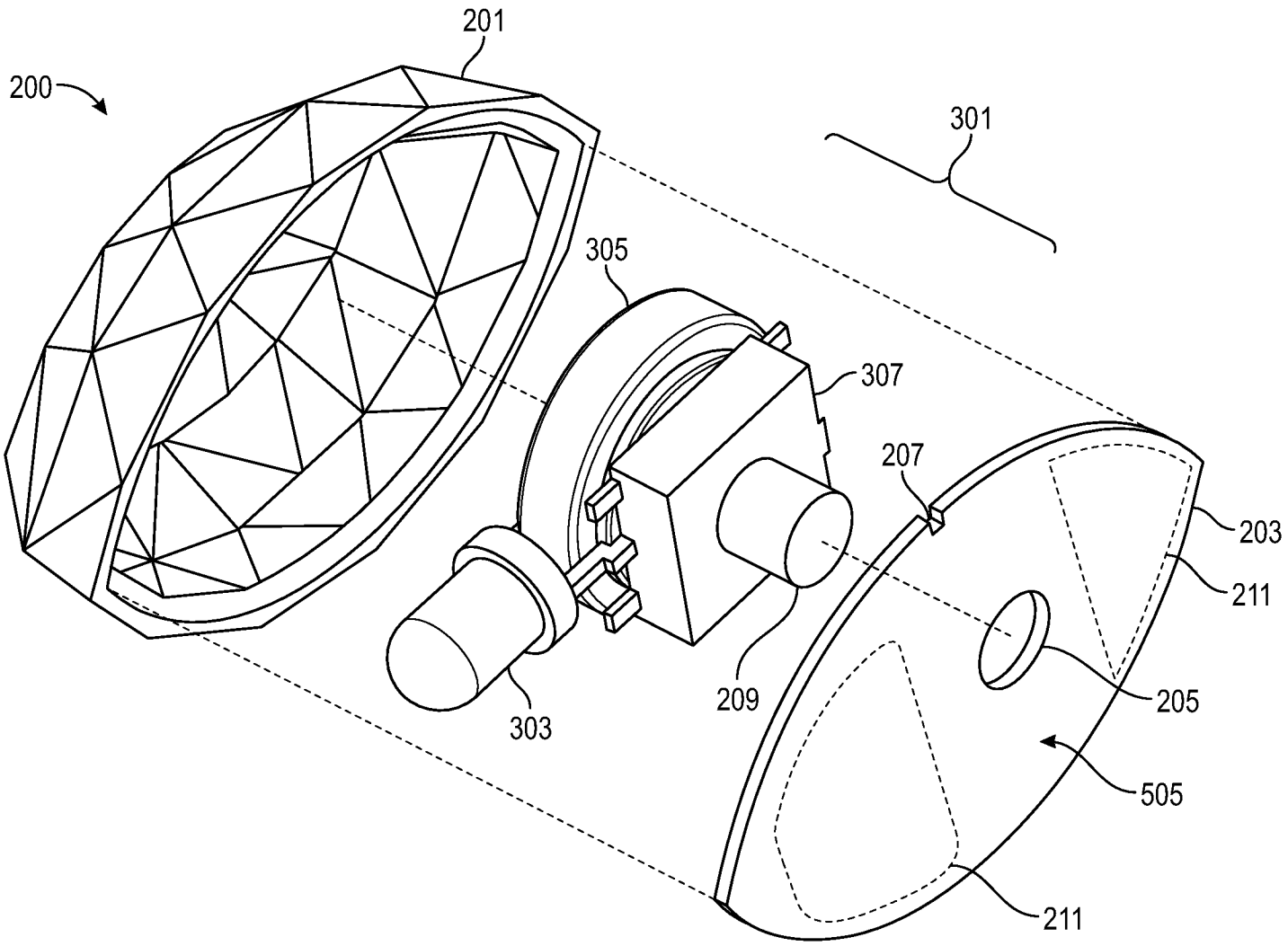

FIG. 3A may depict be a top perspective exploded view of artificial-jewel-with-internal-light-source 200. FIG. 3A may depict be a bottom perspective exploded view of artificial-jewel-with-internal-light-source 200. FIG. 3A and FIG. 3B may depict shell 201 exploded away from base-plate 203, with electronics-assembly disposed in between shell 201 and base-plate 203. In some embodiments, artificial-jewel-with-internal-light-source 200 may comprise shell 201, base-plate 203, and electronics-assembly 301. In some embodiments, when artificial-jewel-with-internal-light-source 200 may be in its assembled configuration (e.g., as shown in FIG. 2C), electronics-assembly 301 may be substantially disposed between shell 201 and base-plate 203, aside from portion(s) of button 209 may protrude out from base-plate 203. In some embodiments, at least portions of electronics-assembly 301 may be an integrated circuit. In some embodiments, at least portions of electronics-assembly 301 may be a printed circuit. In some embodiments, at least portions of electronics-assembly 301 may be a printed circuit board (PCB). In some embodiments, there may be no wires extending out from any portion of electronics-assembly 301.

Continuing discussing FIG. 3A and FIG. 3B, in some embodiments, electronics-assembly 301 may comprise button 209, at least one light-portion 303, at least one power-source 305, and at least one integrated-circuit 307. In some embodiments, at least one light-portion 303 may be operatively connected to both at least one power-source 305 and to at least one integrated-circuit 307. In some embodiments, at least one power-source 305 may be operatively connected to both at least one light-portion 303 and at least one integrated-circuit 307. In some embodiments, button 209 may be operatively connected to at least one integrated-circuit 307. In some embodiments, button 209 may extend out from at least one integrated-circuit 307. In some embodiments, button 209 may protrude out from at least one integrated-circuit 307. In some embodiments, electronics-assembly 301 has no wires protruding from electronics-assembly 301.

In some embodiments, electronics-assembly 301 may not be physically touching any portion of shell 201.

In some embodiments, at least a portion of electronics-assembly 301 may be physically touching an inside-surface 423 of shell 201. In some embodiments, a portion of electronics-assembly 301 that may be physically touching inside-surface 423 of shell 201 may comprise a touch-sensor, such that the at least one light-portion 303 may be activated by a user's human skin touching exterior-surface 400 of shell 201.

In some embodiments, electronics-assembly 301 may comprise one or more: printed circuit boards (PCBs), integrated-circuits, semiconductors, processors, microprocessors, controllers, microcontrollers, memory (e.g., for firmware), antennas, radios, wireless network communication hardware, Bluetooth module, GPS module, accelerometer, gyroscope, touch sensors, force sensors, pressure sensors, combinations thereof, and/or the like.

Continuing discussing FIG. 3A and FIG. 3B, in some embodiments, light-portion 303 may be one or more light sources. In some embodiments, at least one light-portion 303 may be one or more electrically powered light sources. In some embodiments, at least one light-portion 303 may be one or more light emitting diodes (LEDs). In some embodiments, at least one light-portion 303 may be one or more incandescent light sources. In some embodiments, at least one light-portion 303 may be one or more fluorescent light sources. In some embodiments, at least one light-portion 303 may be one or more neon light sources. In some embodiments, at least one light-portion 303 may emit one or more predetermined colors. In some embodiments, at least one light-portion 303 may emit light of one or more predetermined wavelengths. In some embodiments, at least one light-portion 303 may be electrically powered by at least one power source 305. In some embodiments, at least one light-portion 303 may be located inside of the hollow/concave portion of shell 201. In some embodiments, at least one light-portion 303 may be located substantially centrally within shell 201. In some embodiments, at least one light-portion 303 may be located substantially centrally within shell 201 with respect to a transverse-width of shell 201. In some embodiments, at least one light-portion 303 may be located substantially centrally within shell 201 with respect to a longitude (length) of shell 201. In some embodiments, at least one light-portion 303 may be located substantially centrally within shell 201 with respect to a height of shell 201. In some embodiments, at least one light-portion 303 may be oriented substantially parallel with a longitude (length) of shell 201. In this way, at least one light-portion 303 may be located within the hollow/concave portion of shell 201 to optimize shining/emission of light out of shell 201.

In some embodiments, a light emitting portion of the at least one light-portion 303 may be located below a top of shell 201 and above a center of inside-surface 501 of base-plate 203. In some embodiments, a light emitting portion of the at least one light-portion 303 may be located below a top of shell 201, above base 419 of shell 201, and above a center of inside-surface 501 of base-plate 203. In some embodiments, a light emitting portion of the at least one light-portion 303 may be facing a direction that is substantially parallel with a length 401 of shell 201 and with a length 507 of base-plate 203.

Continuing discussing FIG. 3A and FIG. 3B, in some embodiments, at least one power-source 305 may electrically power the electrical components and/or circuitry of artificial-jewel-with-internal-light-source 200 and/or electronics-assembly 301. In some embodiments, at least one power-source 305 may be one or more batteries. In some embodiments, at least one power-source 305 may be one or more rechargeable batteries. In some embodiments, at least one power-source 305 may be one or more dry cell-based batteries. In some embodiments, at least one power-source 305 may be one or more lithium-based batteries. In some embodiments, at least one power-source 305 may be one or more graphene-based batteries. In some embodiments, at least one power-source 305 may be one or more of a predetermined size and/or shape suitable for small mobile electronics of less than 30 mm (millimeters) in length, 20 mm in width and 15 mm in height. In some embodiments, at least one power-source 305 may be one or more standard sized batteries. In some embodiments, at least one power-source 305 may be substantially disk shaped.

In some embodiments, electronics-assembly 301 may comprise at least one power-source 305. In some embodiments, the at least one power-source 305 may be operatively linked to the at least one light-portion 303, wherein the at least one power-source 305 electrically powers the at least one light-portion 303. In some embodiments, the at least one power-source 305 may be operatively linked to one or more of: button 209, the at least one light-portion 303, integrated-circuit 307, combinations thereof, and/or the like.

Continuing discussing FIG. 3A and FIG. 3B, in some embodiments, at least one integrated-circuit 307 may control operations of electronics-assembly 301. In some embodiments, at least one integrated-circuit 307 may permit operation of electronics-assembly 301 by engagement of button 209. In some embodiments, at least one integrated-circuit 307 may permit activation (and deactivation) of at least one light-portion 303. In some embodiments, at least one integrated-circuit 307 may permit activation of light emission from at least one light-portion 303. In some embodiments, at least one integrated-circuit 307 may permit cessation of light emission from at least one light-portion 303. In some embodiments, when button 209 may be pressed in towards at least one integrated-circuit 307 to a predetermined point (depth), at least one integrated-circuit 307 may then permit at least one power-source 305 to electrically power at least one light-portion 303, resulting in light emission from at least one light-portion 303. In some embodiments, when button 209 may be pressed in towards at least one integrated-circuit 307 to a predetermined point (depth), at least one integrated-circuit 307 may then stop at least one power-source 305 from electrically powering at least one light-portion 303, resulting in a cessation of light emission from at least one light-portion 303. In some embodiments, at least portions of at least one integrated-circuit 307 may be an integrated circuit. In some embodiments, at least portions of at least one integrated-circuit 307 may be a printed circuit. In some embodiments, at least portions of at least one integrated-circuit 307 may be a printed circuit board (PCB).

In some embodiments, button 209 may be a means for a user to interface with electronics-assembly 301 of artificial-jewel-with-internal-light-source 200. In some embodiments, button 209 may turn on or off electronics-assembly 301. In some embodiments, button 209 may turn on or off at least one light-portion 303. In some embodiments, button 209 may be a press button. In some embodiments, button 209 may be a push button. In some embodiments, button 209 may be a membrane switch button. In some embodiments, a portion of button 209 may protrude/extend out from hole-for-button 205 of base-plate 203. In some embodiments, button 209 may be located centrally with respect to a transverse-width of base-plate 203 (see e.g., FIG. 2F). In some embodiments, button 209 may be located off center with respect to a longitude (length) of base-plate 203 (see e.g., FIG. 2F). In some embodiments, button 209 may extend/protrude away from the top exterior of shell 201 (see e.g., FIG. 2C). In some embodiments, button 209 may be oppositely disposed away from the top exterior of shell 201 (see e.g., FIG. 2C). In some embodiments, because of button 209's location, with a portion protruding from an exterior/bottom surface of base-plate 203, button 209 may be used (engaged, pressed, pushed, depressed, etc.) while the exterior/bottom surface of base-plate 203 may be removably attached to the region of human skin via sticky adhesive layer 211. In some embodiments, during use, sticky adhesive layer 211 may be removably attached to the region of human skin (such as, but not limited to, face skin and/or chest skin), an exterior most portion of button 209 (e.g., the most distal portion of button 209 extending away from integrated-circuit 307) may also be in physical contact with that region of human skin, and to operate electronics-assembly 301, the user may then just push/press the exterior top of shell 201 with a finger/thumb towards that region of human skin, which may then in turn cause button 209 to be pressed, pushed, and/or depressed, and thus engaging or disengaging electronics-assembly 301. Thus, during use, when sticky adhesive layer 211 may be removably attached to the region of human skin, engagement of button 209 may not impart undesired shear stresses to sticky adhesive layer 211. Thus, during use, when sticky adhesive layer 211 may be removably attached to the region of human skin, turning on or off electronics-assembly 301 may be accomplished by the user (wearer) pushing and/or pressing against the top of shell 201 towards that region of the human skin.

Alternatively, the exterior most portion of button 209 (e.g., the most distal portion of button 209 extending away from integrated-circuit 307) may be engaged directly by a finger and/or thumb, when sticky adhesive layer 211 may not be removably attached to a region of human skin.

In some embodiments, electronics-assembly 301 may comprise at least one push button 209 that may be operatively linked to the at least one light-portion 303 for turning the at least one light-portion 303 on and off. In some embodiments, operative linkage between the at least one light-portion 303 and at least one push button 209 may be direct. In some embodiments, operative linkage between the at least one light-portion 303 and at least one push button 209 may be indirect. In some embodiments, operative linkage between the at least one light-portion 303 and at least one push button 209 may be through one or more of the at least one integrated-circuit 307, the at least one power-source 305, combinations thereof, and/or the like.

In some embodiments, the at least one push button 209 may have a portion that is extendable through a hole (e.g., hole-for-button 205) in base-plate 203. In some embodiments, the at least one push button 209 may be engageable in an up direction and in a down direction, wherein a top of shell 201 faces the up direction and bottom-surface 505 of base-plate 203 faces the down direction. In some embodiments, when sticky-adhesive-layer 211 may be removably stuck to the region of human skin, actuating the at least one push button 209 does not impart a shear stress to artificial-jewel-with-internal-light-source 200.

In some embodiments, when sticky-adhesive-layer 211 may be removably stuck to the region of human skin, a distal portion of the at least one push button 209 (that may be furthest away from the top of shell 201) may be physically contacting the region of human skin, such that actuating the at least one push button 209 may occur by a user (wearer) pressing against the top of shell 201 towards the region of human skin.

In some embodiments, base-plate 203 may be longer than wide, and wider than thick. In some embodiments, base-plate 203 may be substantially planar. In some embodiments, base-plate 203 may be substantially flat. In some embodiments, base-plate 203 may be substantially straight. In some embodiments, base-plate 203 may be substantially rigid. In some embodiments, base-plate 203 may be rigid. In some embodiments, base-plate 203 may be flexible. In some embodiments, an outer perimeter of base-plate 203 (e.g., when viewed from the bottom as in FIG. 2F or FIG. 4F) may be substantially shaped to match (conform to) an outer bottom edge of shell 201. In some embodiments, an outer perimeter of base-plate 203 (e.g., when viewed from the bottom as in FIG. 2F or FIG. 4F) may be substantially shaped to match (conform to) an inset-relief 425 of base 419 of shell 201 (see e.g., FIG. 4E and FIG. 4F for inset-relief 425). In some embodiments, the outer perimeter of base-plate 203 may be define by edge 503 of base-plate 203 (see e.g., FIG. 5A for edge 503).

Figure 4C:
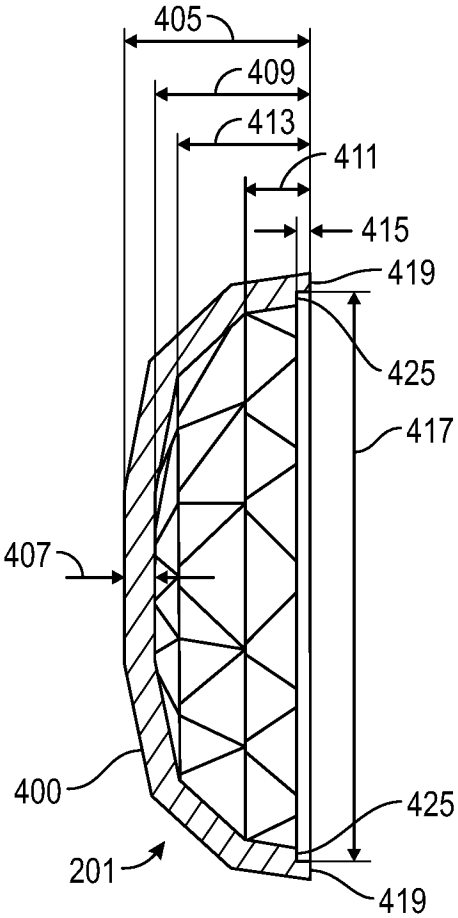
FIG. 4C may be a cross-sectional view of a shell along sectional line 4C-4C from FIG. 4B.
Figure 4B:
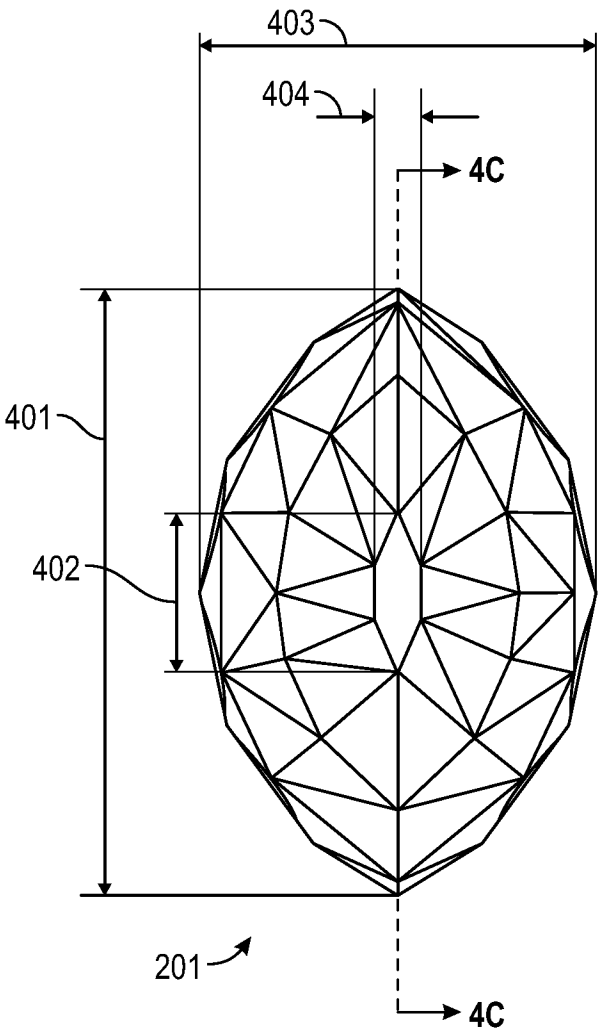
FIG. 4B may depict a top view of a shell, showing as a crown of an artificial-jewel-with-internal-light-source.
Figure 4A:
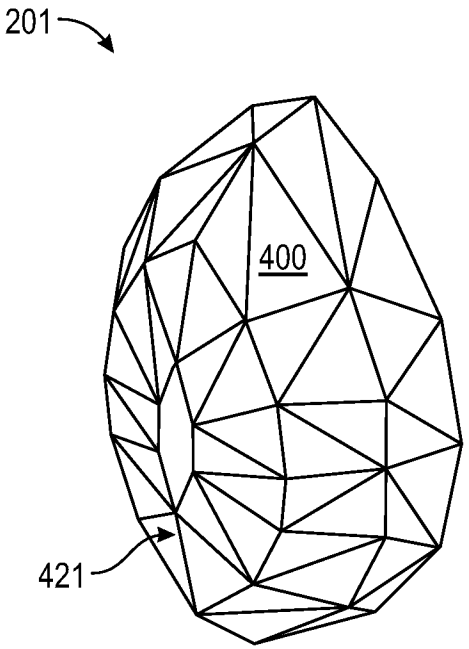
FIG. 4A may depict a top perspective view of a shell of an artificial-jewel-with-internal-light-source.
Figure 4D:
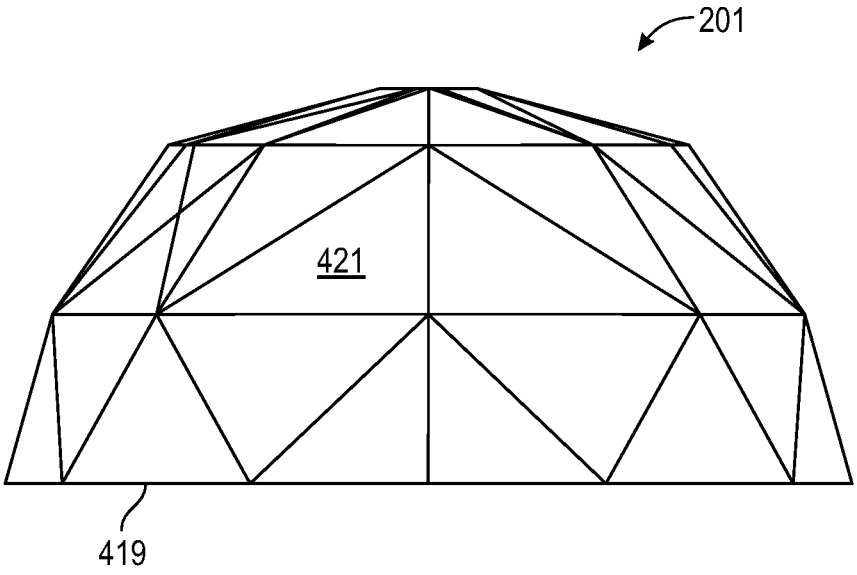
FIG. 4D may depict a transverse width side view of a shell.
Figure 4E:
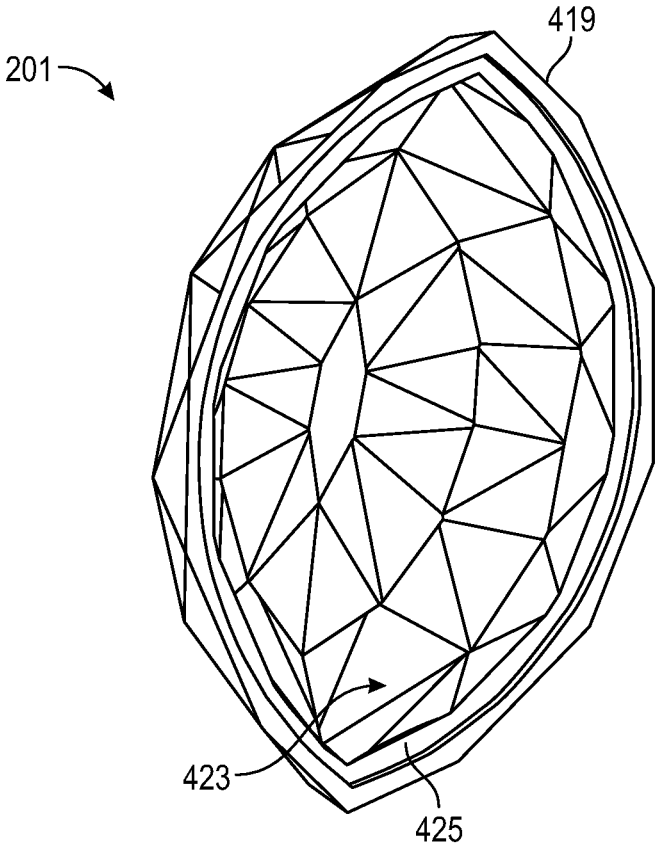
FIG. 4E may depict a bottom perspective view of a shell.
Figure 4F:
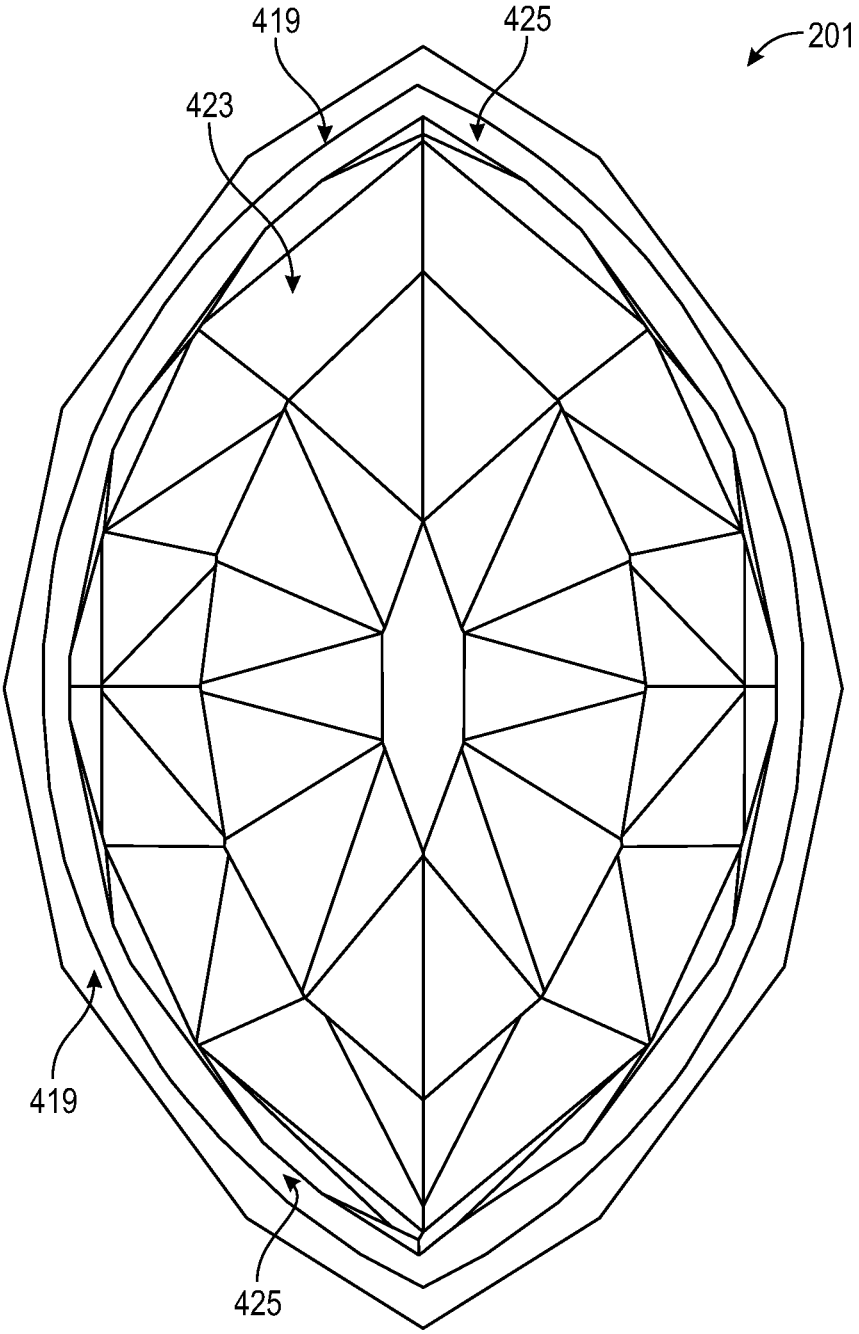
FIG. 4F may depict a bottom view of a shell.

FIG. 4A through and including FIG. 4F may depict various views of shell 201. In FIG. 4A through and including FIG. 4F, base-plate 203 and electronics-assembly 301 may not be shown. FIG. 4A may depict a top perspective view of shell 201. FIG. 4B may depict a top view of shell 201. FIG. 4B may show the crown of shell 201. FIG. 4B may include sectional line 4C-4C through a lengthwise middle of shell 201. FIG. 4C may be cross-sectional view of shell 201 along sectional line 4C-4C from FIG. 4B. FIG. 4D may depict a transverse width side view of shell 201. FIG. 4E may depict a bottom perspective view of shell 201. FIG. 4F may depict a bottom view of shell 201.

FIG. 4A and FIG. 4B may show an exterior-surface 400 of shell 201. In some embodiments, shell 201 may comprise an exterior-surface 400. In some embodiments, exterior-surface 400 may be the outer surfaces of shell 201. In some embodiments, exterior-surface 400 may be divided into one or more faces. In some embodiments, exterior-surface 400 may be divided into one or more facets 421. In some embodiments, shell 201 may comprise a plurality of facets 421. In some embodiments, shell 201 may comprise one or more facets 421. In some embodiments, shell 201 may comprise at least one facet 421. See e.g., FIG. 4A and FIG. 4B.

Discussing FIG. 4B, in some embodiments, a given shell 201 may have a length 401 and a maximum width 403 (transverse width). In some embodiments, length 401 may be longer than width 403. In some embodiments, length 401 and width 403 may be substantially orthogonal with respect to each other. In some embodiments, length 401 may be fixed and predetermined. In some embodiments, width 403 may be fixed and predetermined.

Continuing discussing FIG. 4B, in some embodiments, the crown of the given shell 201 may have a table. In some embodiments, the table have may a length, a top-length 402. In some embodiments, top-length 402 may be substantially parallel with length 401. In some embodiments, the table have may a width, a top-width 404. In some embodiments, top-width 404 may be substantially parallel with width 403. In some embodiments, top-length 402 may be longer than top-width 404. In some embodiments, top-length 402 and top-width 404 may be substantially orthogonal with respect to each other. In some embodiments, top-length 402 may be fixed and predetermined. In some embodiments, top-width 404 may be fixed and predetermined.

In some embodiments, length 401 may be 23 mm (millimeters), width 403 may be 15 mm, top-length 402 may be 6.50 mm, and top-width 404 may be 1.75 mm. In other embodiments, length 401, width 403, top-length 402, and top-width 404 may be other dimensions.

Discussing FIG. 4C, in some embodiments, a given shell 201 may have a given height 405 from shell 201's base 419 to a top most portion of shell 201, wherein the top most portion of shell 201 may be disposed opposite from base 419. In some embodiments, the top most portion of shell 201 may be table of shell 201. In some embodiments, height 405 may be substantially orthogonal to both length 401 and width 403. In some embodiments, height 405 may be less than length 401. In some embodiments, height 405 may be less than width 403. In some embodiments, it may be desirable to minimize height 405, in order to both minimize weight of shell 201 and to provide a lower profile of shell 201, to in turn minimize unintended impacts with the environment that might knock artificial-jewel-with-internal-light-source 200 off of the region of human skin that artificial-jewel-with-internal-light-source 200 may be removably attached to. In some embodiments, height 405 may be fixed and predetermined. In some embodiments, height 405 may be 7 mm (millimeters) or less. In some embodiments, height 405 may be from 7 mm to 1 mm. In some embodiments, height 405 being 7 mm or less may minimize unintended impacts between an object in the environment and artificial-jewel-with-internal-light-source 200, when artificial-jewel-with-internal-light-source 200 may be removably attached to the region of human skin. Objects in the environment that can impact artificial-jewel-with-internal-light-source 200 may include: the wearer's own body parts, other people, clothing, furniture, combinations thereof, and/or the like. Weather conditions, such as, high wind, high humidity, rain, precipitation, and/or the like may also contribute to knocking artificial-jewel-with-internal-light-source 200 off from the region of human skin; wherein minimizing the overall weight and/or height 405 of artificial-jewel-with-internal-light-source 200 may minimize such environmental issues.

Continuing discussing FIG. 4C, in some embodiments, a given shell 201 may have a thickness, shell-thickness 407. In some embodiments, shell 201 may have shell-thickness 407 between exterior-surface 400 of shell 201 and inside-surface 423 of shell 201. In some embodiments, shell-thickness 407 may be a distance between exterior-surface 400 and of an inside-surface 423 a given shell 201. (Inside-surface 423 may be shown in FIG. 4E and in FIG. 4F.) In some embodiments, shell-thickness 407 may be fixed and predetermined; however, at different regions of shell 201, shell-thickness 407 may have a different thickness. In some embodiments, shell-thickness 407 may be fixed and predetermined with a substantially uniform thickness over shell 201. In some embodiments, shell-thickness 407 may be configured to substantially permit passage of light in the visual spectrum (according to human eyes).

Continuing discussing FIG. 4C, in some embodiments, a given shell 201 may have a base-to-inside-top 409 distance that may be fixed and predetermined. In some embodiments, base-to-inside-top 409 distance may be a dimension from base 419 to a top most portion of inside-surface 423. In some embodiments, base-to-inside-top 409 distance may be less than height 405.

Continuing discussing FIG. 4C, in some embodiments, a given shell 201 may have a height 411 that may be fixed and predetermined. In some embodiments, height 411 may be a height from base 419 to where a first band of facets 421 ends on shell 201.

Continuing discussing FIG. 4C, in some embodiments, a given shell 201 may have a height 413 that may be fixed and predetermined. In some embodiments, height 413 may be a height from base 419 to where a second band of facets 421 ends on shell 201. In some embodiments, height 413 may include height 411.

Continuing discussing FIG. 4C, in some embodiments, a given shell 201 may have a height 415 that may be fixed and predetermined. In some embodiments, height 415 may be a height of a boundary that may surround and bound an inset-relief 425. Inset-relief 425 may be shown in FIG. 4E and in FIG. 4F. In some embodiments, inset-relief 425 may be a contoured shelf that may be cut into base 419 of shell 201. In some embodiments, the peripheral edges of inset-relief 425 may be configured to received base-plate 203. In some embodiments, a shape of inset-relief 425 may be substantially similar to a shape of the peripheral edges of base-plate 203. In some embodiments, a size of base-plate 203 may be smaller than inset-relief 425. In some embodiments, a shape and a size of inset-relief 425 may be substantially similar to a shape and size of the peripheral edges of base-plate 203. In some embodiments, base-plate 203 may be fitted into inset-relief 425. In some embodiments, base-plate 203 may be attached into inset-relief 425. In some embodiments, base-plate 203 may be snap fitted into inset-relief 425. In some embodiments, base-plate 203 may be friction fitted into inset-relief 425. In some embodiments, base-plate 203 may be glued into inset-relief 425. In some embodiments, base-plate 203 may be welded into inset-relief 425. In some embodiments, base-plate 203 may be heat welded into inset-relief 425. In some embodiments, base-plate 203 may be ultrasonic welded into inset-relief 425. In some embodiments, base-plate 203 may be solvent welded into inset-relief 425.

Continuing discussing FIG. 4C, in some embodiments, a given shell 201 may have a length-of-inset-relief 417 that may be fixed and predetermined. In some embodiments, length-of-inset-relief 417 may be a length of inset-relief 425. In some embodiments, length-of-inset-relief 417 may be substantially parallel with length 401. In some embodiments, length-of-inset-relief 417 may be longer than a length 507 of base-plate 203. In some embodiments, length-of-inset-relief 417 may be substantially similar to length 507 of base-plate 203.

In some embodiments, height 405 may be 7 mm, shell-thickness 407 may be 1 mm, base-to-inside-top 409 distance may be 6 mm, height 411 may be 2.5 mm, height 413 may be 5 mm, height 415 may be 0.5 mm, and length-of-inset-relief 417 may be 21.5 mm. In other embodiments, height 405, shell-thickness 407, base-to-inside-top 409 distance, height 411, height 413, height 415, and length-of-inset-relief 417 may be other dimensions.

In some embodiments, exterior-surface 400 of shell 201 may be convex and the inside-surface 423 of shell 201 may be concave such that when base-plate 203 may be attached to shell 201, a volume (a substantially enclosed volume) is defined between inside-surface 423 of shell 201 and inside-surface 501 of base-plate 203. In some embodiments, the part (or at least a portion) of electronics-assembly 301 may occupy this volume between shell 201 and base-plate 203.

In some embodiments, a crown of shell 201 may be shaped and/or sized as a typical faceted and/or cut gemstone that is commonly found and/or known in the fine jewelry industry.

In some embodiments, a crown of shell 201 may be shaped and/or sized as a typical faceted and/or cut gemstone that is commonly found and/or known in the fine jewelry industry, such as, but not limited to, marquise.

Figure 8:
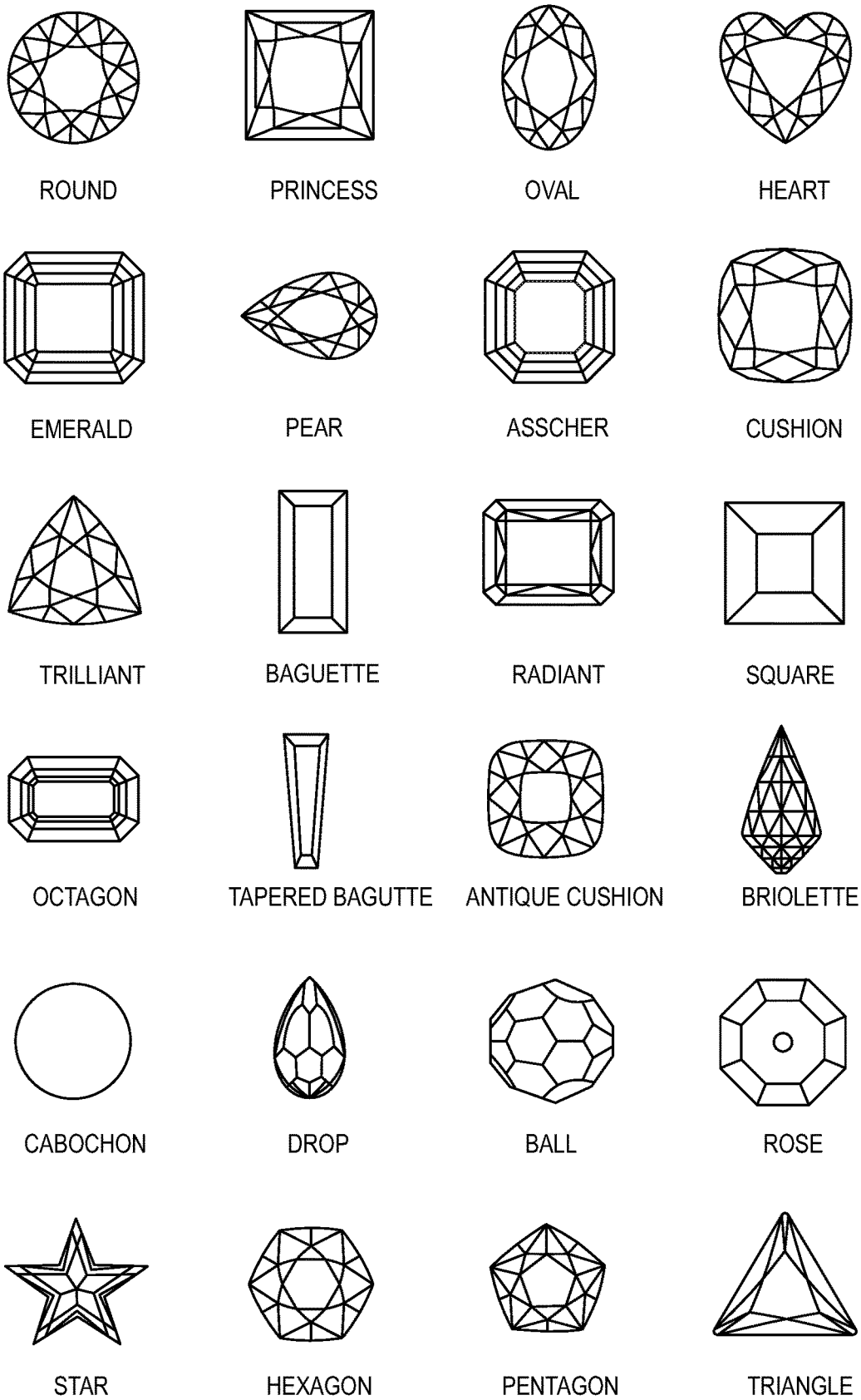
FIG. 8 depicts a plurality of different styles (cuts) of gemstones from a top view; wherein shells of the present invention may be implemented to substantially mimic any one of these shown styles (cuts) of gemstones.

In some embodiments, a crown of shell 201 may be shaped and/or sized as a typical faceted and/or cut gemstone that is commonly found and/or known in the fine jewelry industry, such as, but not limited to: antique cushion, asscher, baguette, brilliant, briolette, bullet, cabochon, ceylon, checkerboard, classic round, cross rose, cushion, drop, double, double rose, eight, eight corners, emerald, emerald radiant, English round, fancy, French, fine round, half clutch rose, half rose, heart, hexagon, holland rose, marquise, mixed, mogul, navette, octagon, old miner's, old European, old single, oval, pampel, pear, pendeloque, pentagon, point, princess, radiant, rectangle, rectangular, rose, royal, round, scissor split brilliant, square, square brilliant, star, step, table, tapered baguette, tear, tear drop, thin, trapeze, triangle, trilliant, trillion, unique, combinations thereof, and/or the like. The shapes of such styles/cuts of gemstones are well known and understood in the relevant arts. See e.g., FIG. 8 which depicts a plurality of different styles (cuts) of gemstones from a top view; wherein shells 201 of the present invention may be implemented (e.g., shaped) to substantially mimic any one of these shown styles (cuts) of gemstones (from a top view and/or from side views).

In some embodiments, a pavilion of shell 201 may be one or more of flat, planar, substantially flat, substantially planar, combinations thereof, and/or the like. In some embodiments, when shell 201 may be viewed from a side, base 419 of shell 201 may be flat or substantially flat.

In some embodiments, a pavilion of artificial-jewel-with-internal-light-source 200 may be one or more of flat, planar, substantially flat, substantially planar, combinations thereof, and/or the like.

In some embodiments, a given shell 201 may be substantially constructed from one or more of the following materials: glass, plastic, resin, elastomer, gem, gemstone, geode, crystal, mineral, combinations thereof, and/or the like.

In some embodiments, a given shell 201 may be manufactured by one or more of: molding, injection molding, casting, cutting, milling, grinding, machining, 3D printing, polishing, combinations thereof, and/or the like.

In some embodiments, upper portions of shell 201 may be transparent, translucent, optically transparent, optically translucent, substantially transparent, substantially translucent, substantially optically transparent, substantially optically translucent, combinations thereof, and/or the like, with respect to a visual light spectrum for human eyes. In some embodiments, at least a portion of shell 201 may be substantially optically transparent with respect to wavelengths of light visible to a naked human eye.

In some embodiments, a surface (exterior and/or interior) of shell 201 may be at least partially covered in a film, a coating, combination thereof, and/or the like. In some embodiments, such a film and/or coating may provide protection to shell 201, such as, but not limited to, protection against scratching, protection against UV (ultraviolet) radiation, etc. In some embodiments, such a film and/or coating may provide various predetermined optical effects, such as, but not limited to, reflective properties, refractive properties, polarizing properties, combinations thereof, and/or the like.

Figure 5A:
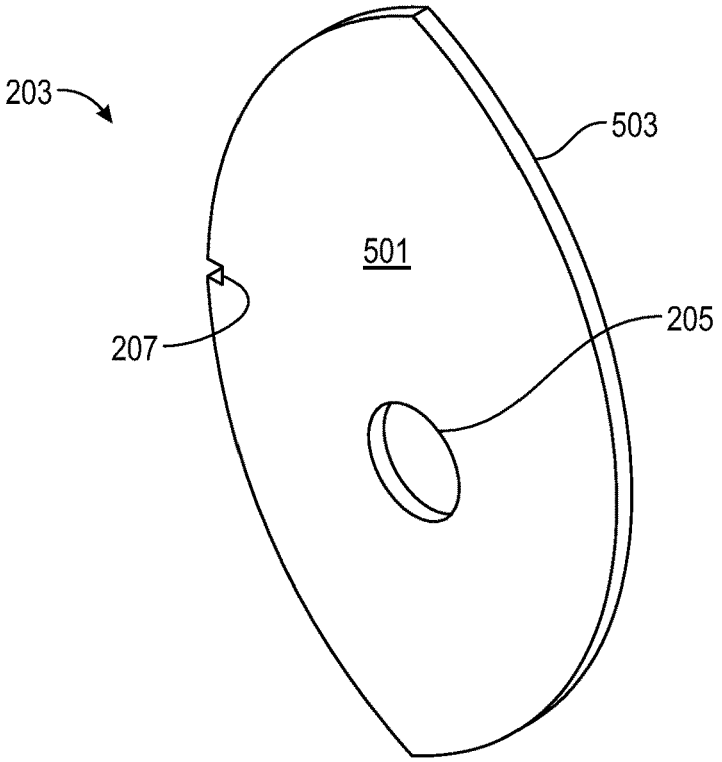
FIG. 5A may be top perspective view of a base-plate of an artificial-jewel-with-internal-light-source, showing an inside-surface of the base-plate.
Figure 5B:
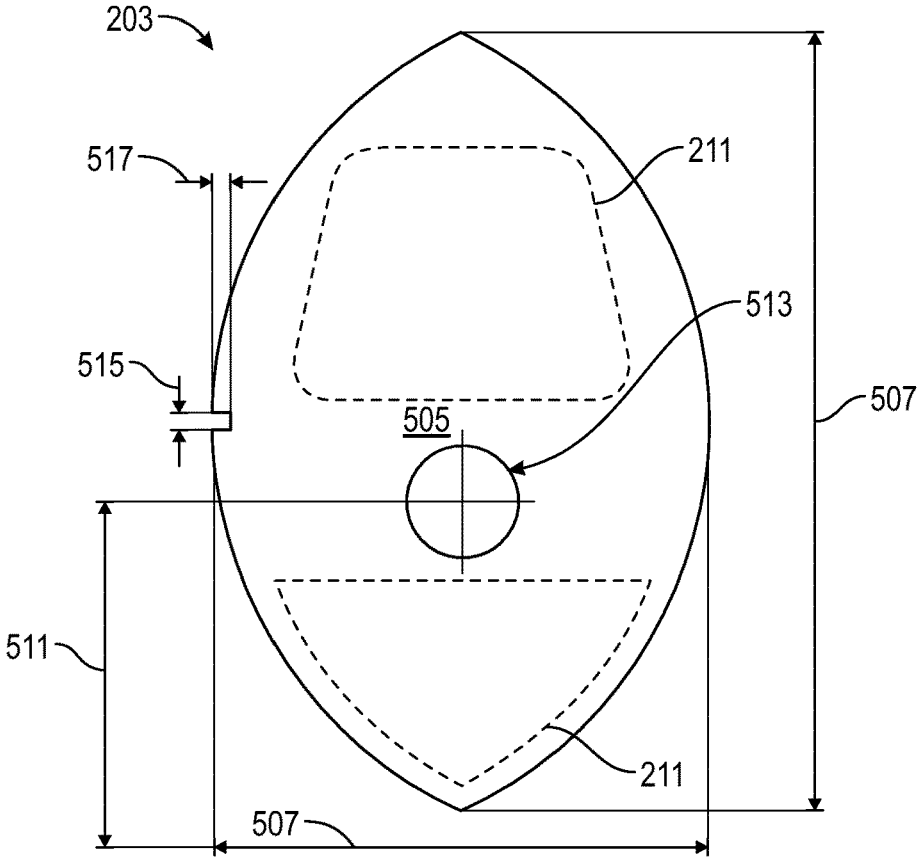
FIG. 5B may be a bottom view of a base-plate.
Figure 5C:
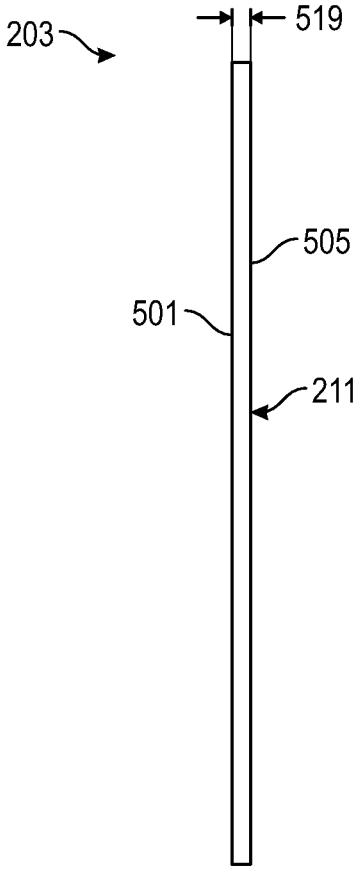
FIG. 5C may be a side view (longitudinal side view) of a base-plate.
Figure 5D:
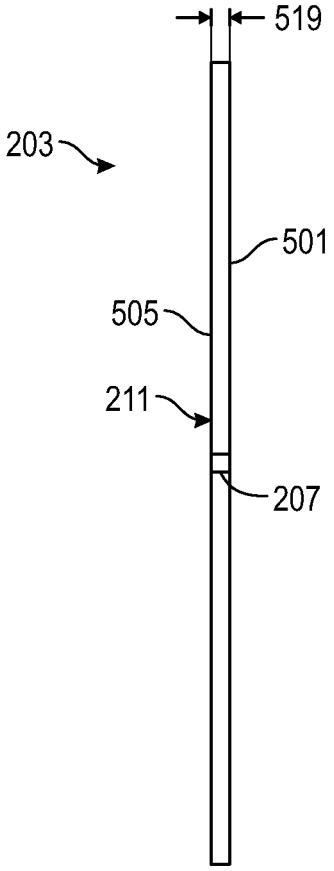
FIG. 5D may be an opposing side view (longitudinal side view) of a base-plate as compared to FIG. 5C.

FIG. 5A through and including FIG. 5D may depict various views of base-plate 203. In FIG. 5A through and including FIG. 5D shell 201 and electronics-assembly 301 may not be shown. FIG. 5A may be top perspective view of base-plate 203 showing an inside-surface 501 of base-plate 203. FIG. 5B may be a bottom view of base-plate 203. FIG. 5C may be side view (longitudinal side view) of base-plate 203. FIG. 5D may be an opposing side view (longitudinal side view) of base-plate 203 as compared to FIG. 5C.

Discussing FIG. 5A through FIG. 5D, in some embodiments, base-plate 203 may be substantially flat and planar member with a thickness 519, wherein base-plate 203 may comprise a bottom-surface 505 and disposed opposite of bottom-surface 505 an inside-surface 501. In some embodiments, inside-surface 501 and bottom-surface 505 may be opposing major surfaces of base-plate 203. In some embodiments, when artificial-jewel-with-internal-light-source 200 may be assembled, and base-plate 203 may be attached to shell 201, the inside-surface 501 may not be readily visible (aside from viewing through transparent shell 201). In some embodiments, a portion of substantially flat inside-surface 501 may be coated with an optically reflective film. In some embodiments, when artificial-jewel-with-internal-light-source 200 may be assembled, and base-plate 203 may be attached to shell 201, at least portions of bottom-surface 505 may be in physical contact with the region of human skin. In some embodiments, at least some portions of bottom-surface 505 may be covered in sticky adhesive layer 211. In some embodiments, around a peripheral edge of base-plate 203 may be edge 503. In some embodiments, edge 503 may have a dimension of thickness 519. In some embodiments, base-plate 203 may have hole-for-button 205, a through hole in base-plate 203, from inside-surface 501 to bottom-surface 505. In some embodiments, edge 503 may have at least one notch 207. In some embodiments, an overall outer shape of base-plate 203, around edge 503, may match an equivalent shape of inset-relief 425 in base 419 of shell 201, such that base-plate 203 may be fitted into inset-relief 425.

In some embodiments, base-plate 203 may be a solid member. In some embodiments, base-plate 203 may be a solid member, with at least one hole (e.g., hole-for-button 205). In some embodiments, base-plate 203 may be a solid member, with at least one hole (e.g., hole-for-button 205) and with at least one notch 207. In some embodiments, the at least one hole (e.g., hole-for-button 205) in base-plate 203 may go entirely through a planar portion of base-plate 203.

Discussing FIG. 5B, in some embodiments, base-plate 203 may have a length 507 and a maximum width 509 (transverse width). In some embodiments, length 507 may be longer than width 509. In some embodiments, length 507 and width 509 may be substantially orthogonal with respect to each other. In some embodiments, length 507 may be fixed and predetermined. In some embodiments, width 509 may be fixed and predetermined.

Continuing discussing FIG. 5B, in some embodiments, base-plate 203 may have hole-distance 511. In some embodiments, hole-distance 511 may be a distance to a center of hole-for-button 205 to closest edge 503 in a manner what is parallel to length 507. In some embodiments, hole-distance 511 may be fixed and predetermined. In some embodiments, hole-distance 511 may place hole-for-button 205 off center with respect to length 507. In some embodiments, hole-for-button 205 may have a diameter 513. In some embodiments, diameter 513 may be fixed and predetermined. In some embodiments, diameter 513 may be greater than a diameter of button 209.

Continuing discussing FIG. 5B, in some embodiments, notch 207 may have a notch-width 515 and a notch-depth 517. In some embodiments, notch-width 515 may be longer than notch-depth 517. In some embodiments, notch-width 515 may be shorter than notch-depth 517. In some embodiments, notch-width 515 may be substantially the same as notch-depth 517. In some embodiments, notch-width 515 and notch-depth 517 may be substantially orthogonal with respect to each other. In some embodiments, notch-width 515 may be fixed and predetermined. In some embodiments, notch-depth 517 may be fixed and predetermined.

In some embodiments, length 507 may be 21.5 mm (millimeters), width 509 may be 14 mm, hole-distance 511 may be 8.6 mm, diameter 513 may be 3.1 mm, notch-width 515 may be 0.5 mm, notch-depth 517 may be 0.5 mm, and thickness 519 may be 0.5 mm. In other embodiments, length 507, width 509, hole-distance 511, diameter 513, notch-width 515, notch-depth 517, and thickness may be other dimensions. In other embodiments, other predetermined dimensions may be applicable.

Figure 6A:
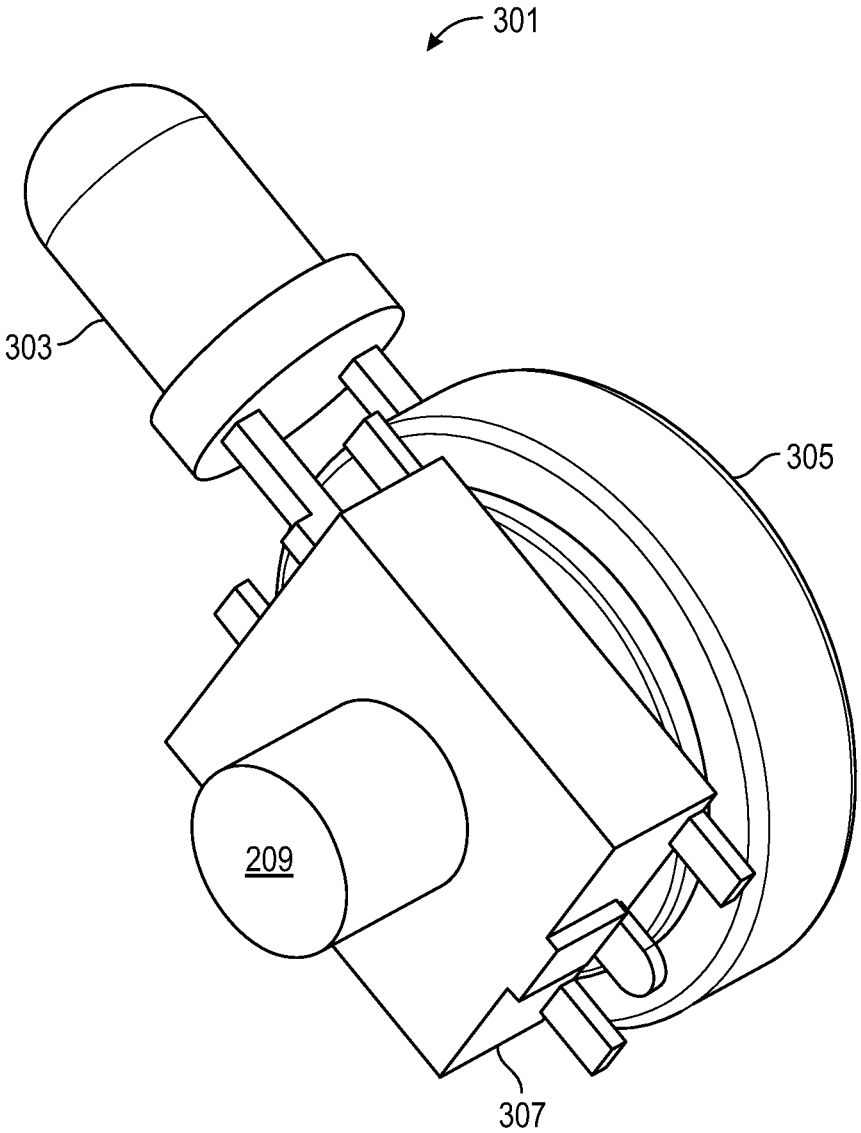
FIG. 6A may be a bottom perspective view of an electronics-assembly for an artificial-jewel-with-internal-light-source.
Figure 6B:
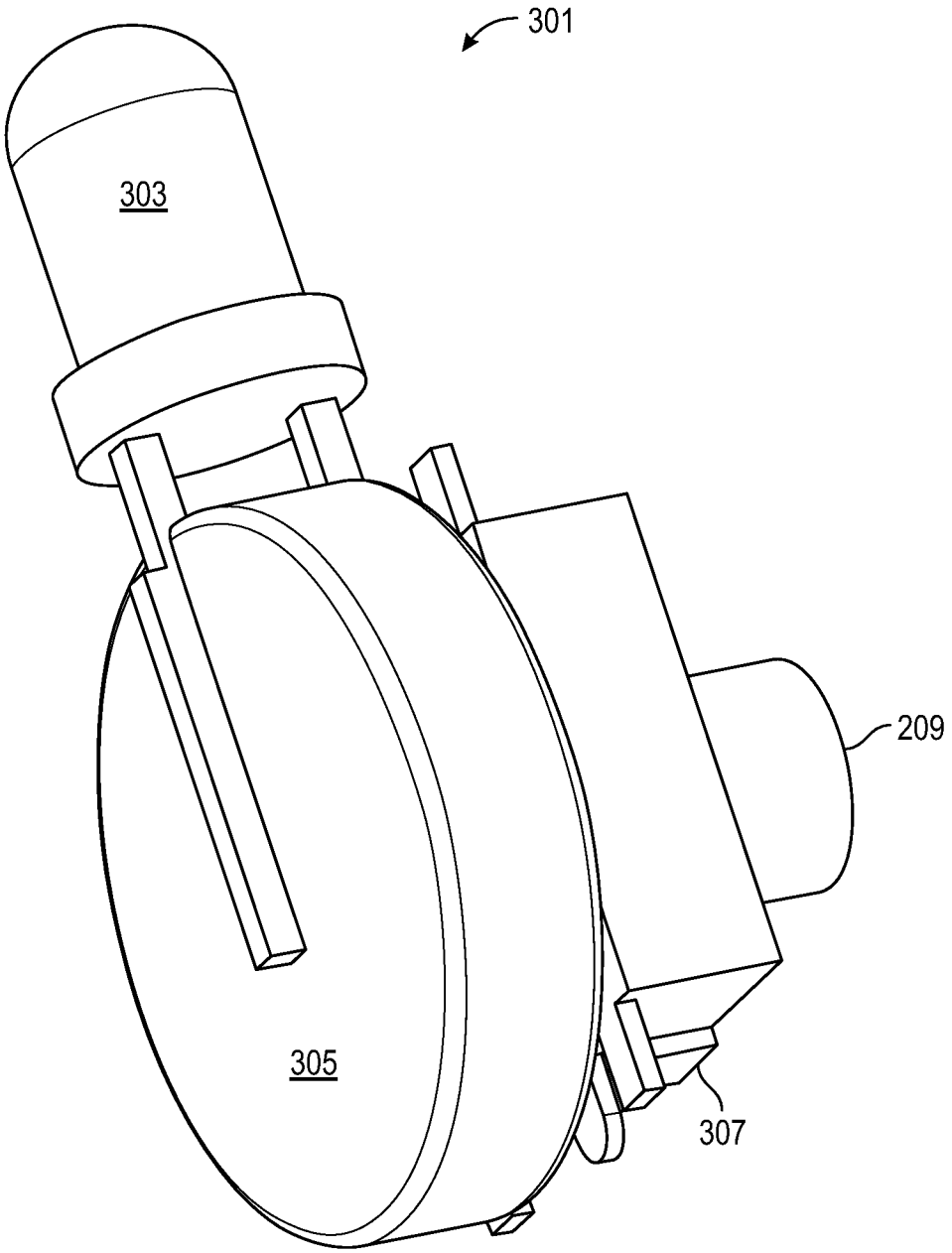
FIG. 6B may be a top perspective view of an electronics-assembly for an artificial-jewel-with-internal-light-source.
Figure 6C:
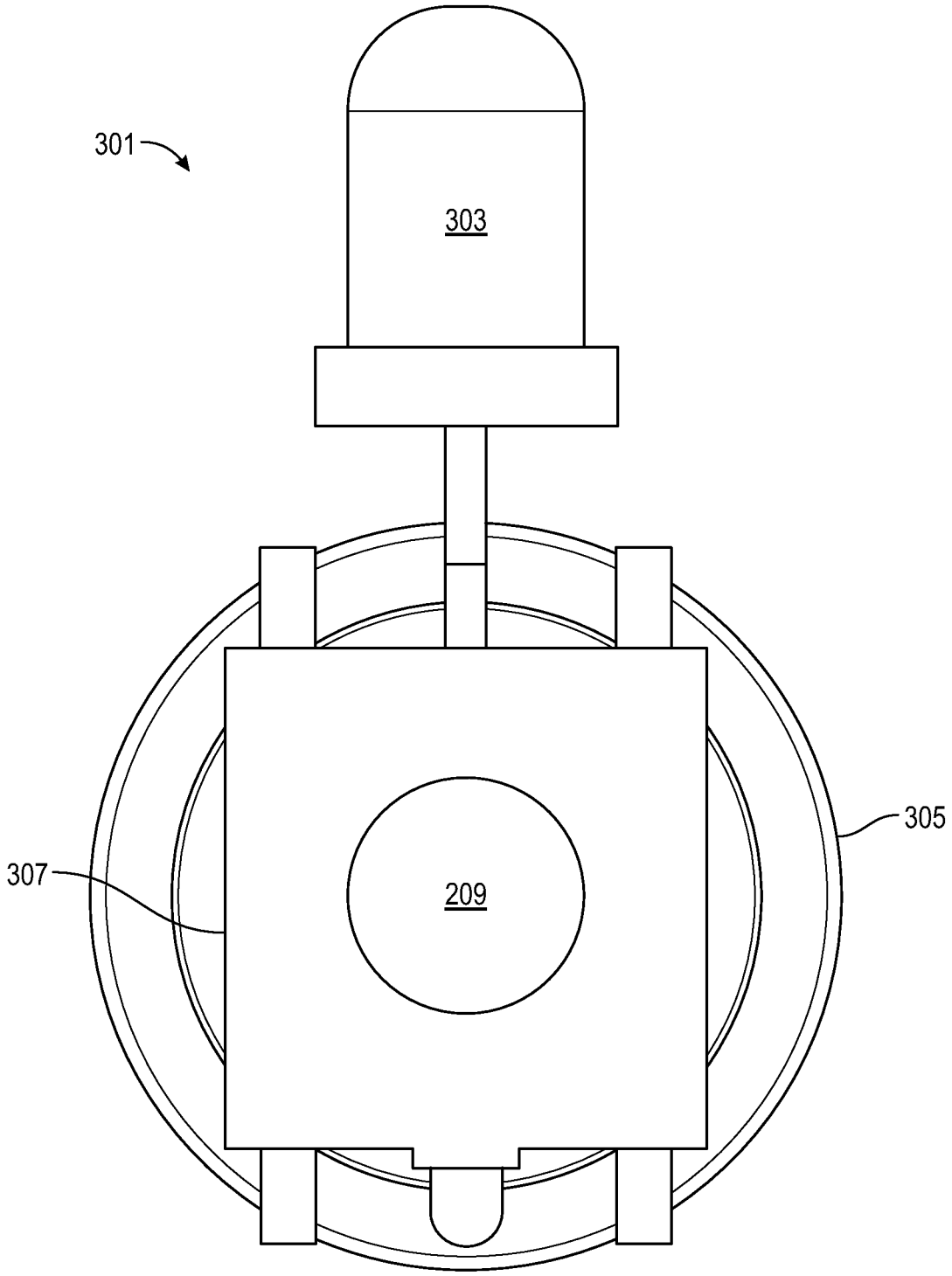
FIG. 6C may be a bottom view of an electronics-assembly for an artificial-jewel-with-internal-light-source.
Figure 6D:
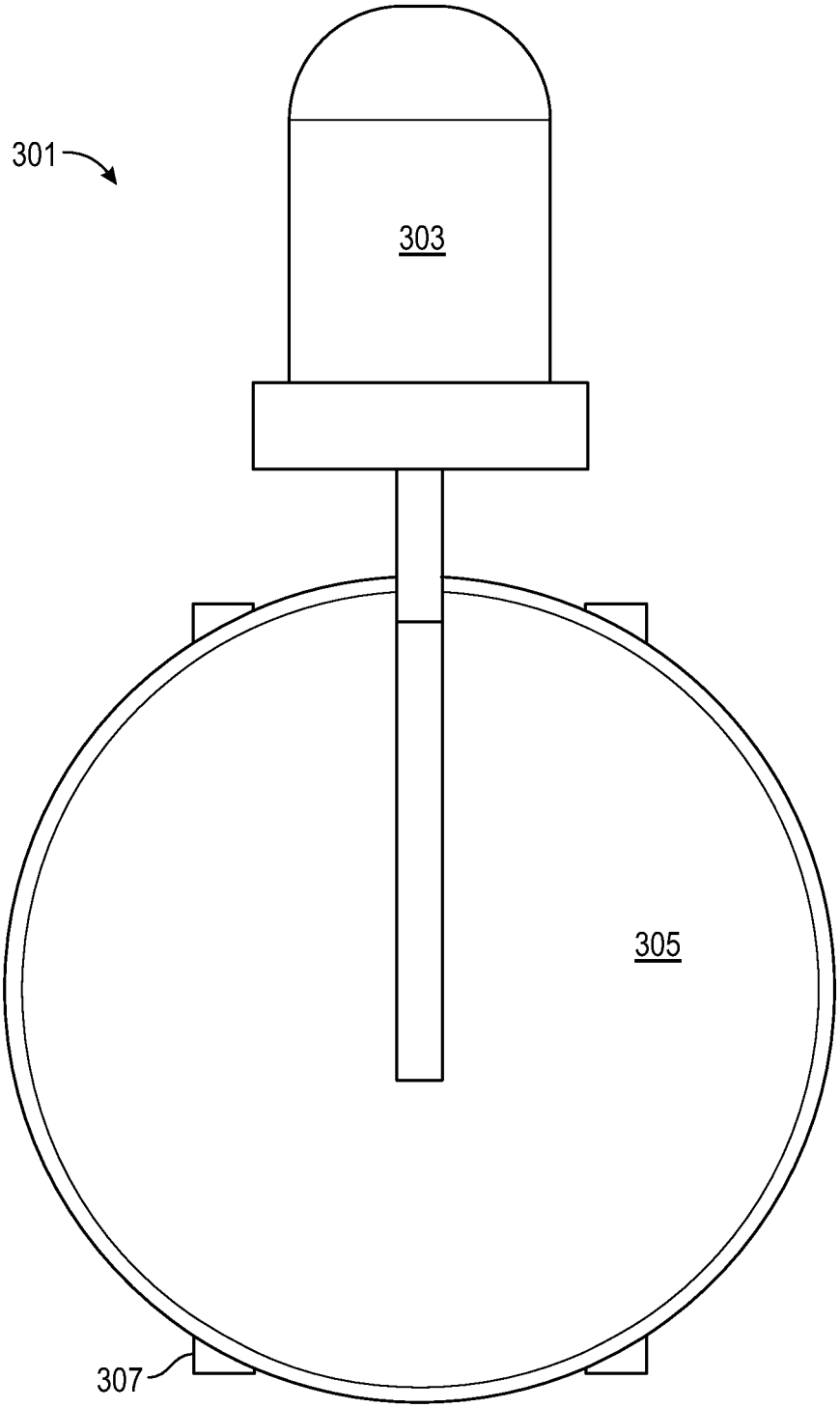
FIG. 6D may be a top view of an electronics-assembly for an artificial-jewel-with-internal-light-source.
Figure 6E:
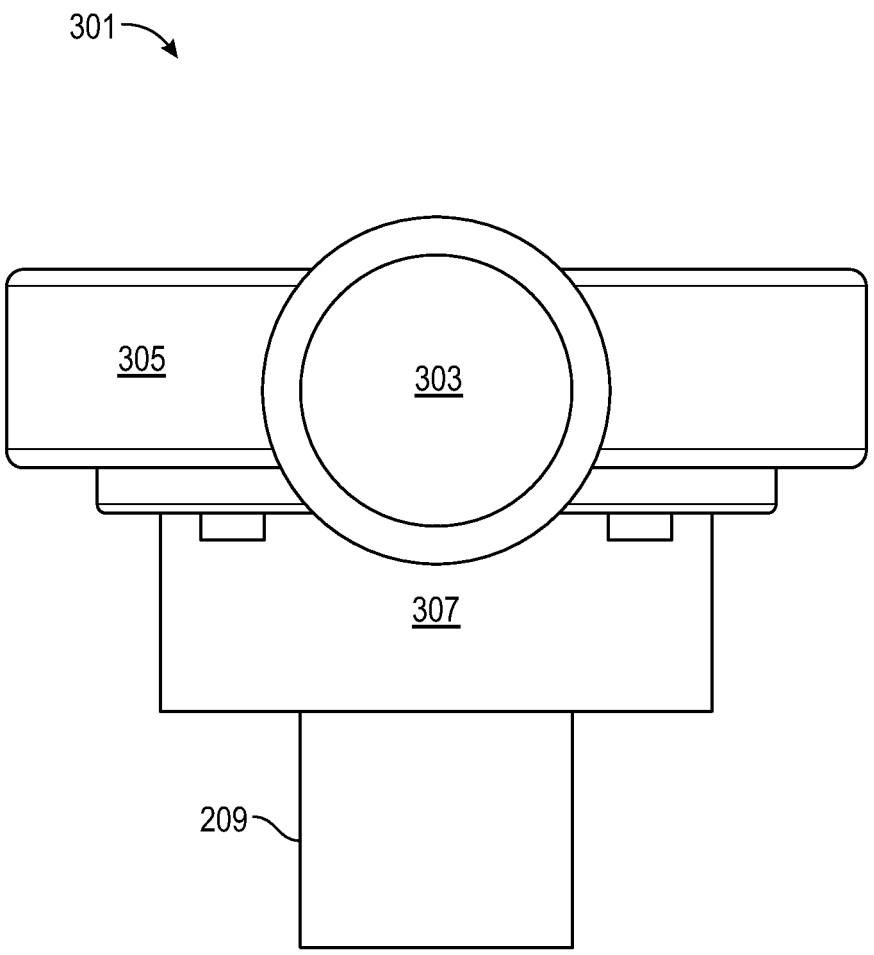
FIG. 6E may be a front view of an electronics-assembly for an artificial-jewel-with-internal-light-source.
Figure 6F:
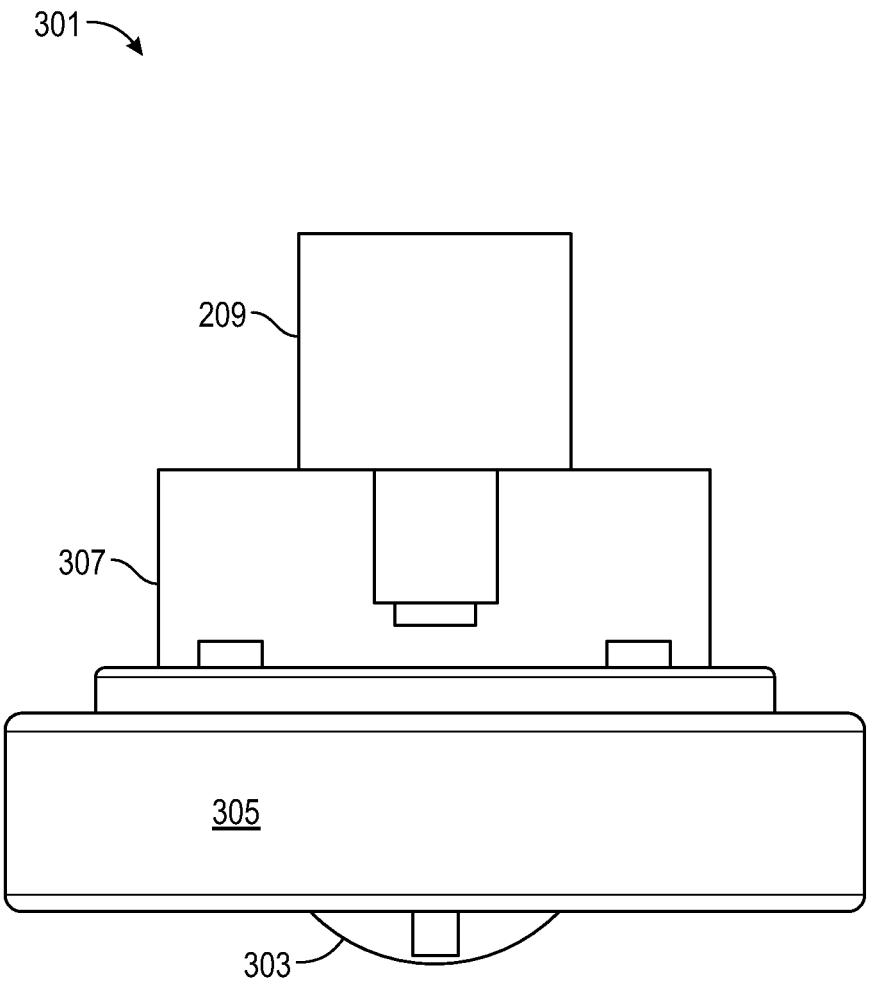
FIG. 6F may be a rear (back) view of an electronics-assembly for an artificial-jewel-with-internal-light-source.
Figure 6G:
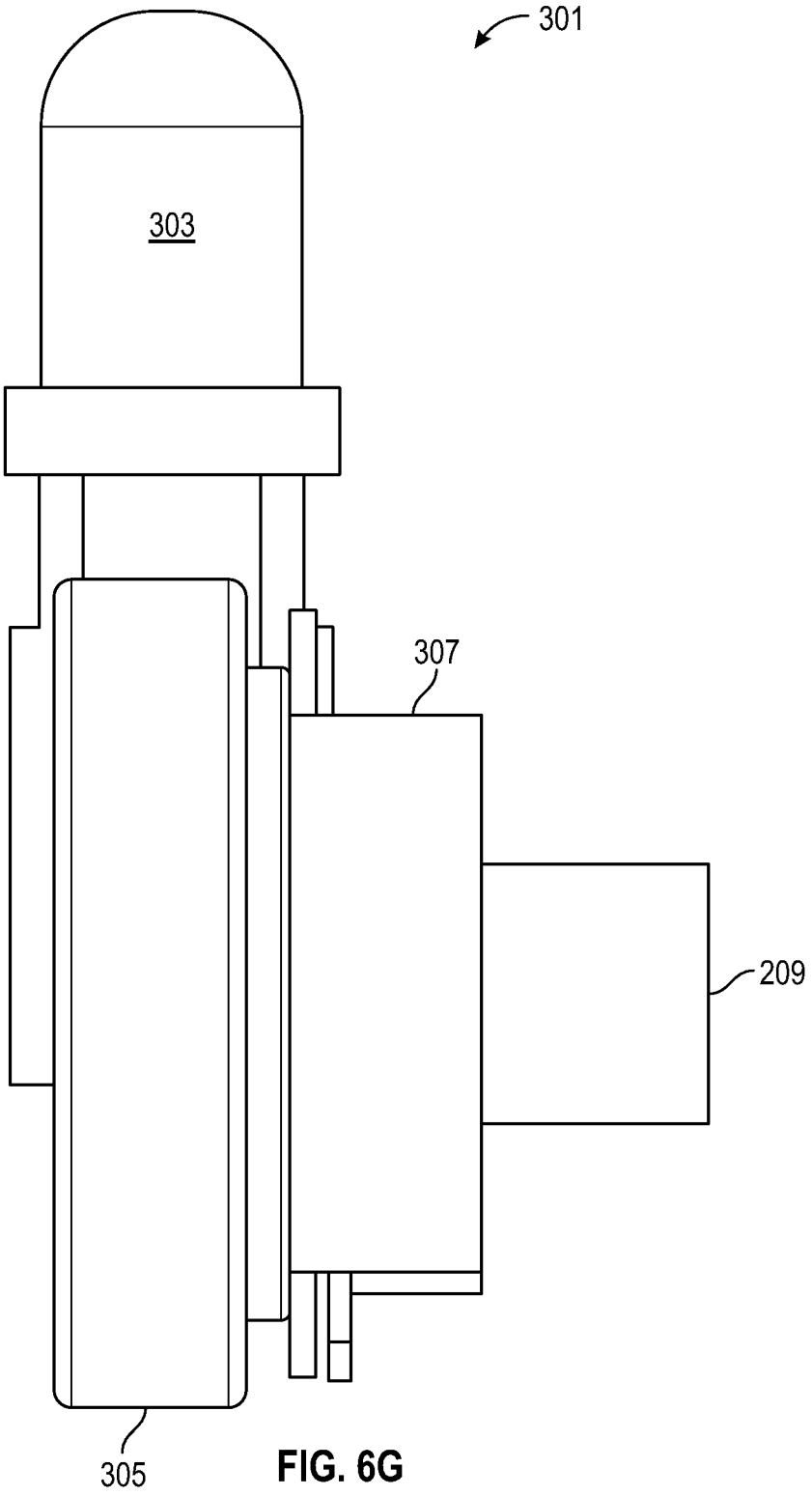
FIG. 6G may be a lengthwise side view (right and/or left) of an electronics-assembly for an artificial-jewel-with-internal-light-source.

FIG. 6A through and including FIG. 6G may show electronics-assembly 301 from various viewing angles. In FIG. 6A through and including FIG. 6G shell 201 and base-plate 203 may not be shown. FIG. 6A may be a bottom perspective view of electronics-assembly 301. FIG. 6B may be a top perspective view of electronics-assembly 301. FIG. 6C may be a bottom view of electronics-assembly 301. FIG. 6D may be a top view of electronics-assembly 301. FIG. 6E may be a front view of electronics-assembly 301. FIG. 6F may be a rear (back) view of electronics-assembly 301. FIG. 6G may be a lengthwise side view (right and/or left) of electronics-assembly 301.

In some embodiments, when artificial-jewel-with-internal-light-source 200 may be assembled, only a bottom portion of button 209 of electronics-assembly 301 may extend out from beneath base-plate 203. In some embodiments, when artificial-jewel-with-internal-light-source 200 may be assembled, only a bottom portion of button 209 of electronics-assembly 301 may be exteriorly visible, with a remainder of electronics-assembly 301 being inside of shell 201; although, a portion of electronics-assembly 301 may be visible through transparent shell 201 when electronics-assembly 301 may be inside of shell 201.

In some embodiments, when artificial-jewel-with-internal-light-source 200 may be assembled, only a bottom portion of button 209 of electronics-assembly 301 may be exteriorly visible, with a remainder of electronics-assembly 301 being disposed between shell 201 and base-plate 203; although, a portion of electronics-assembly 301 may be visible through transparent shell 201 when electronics-assembly 301 may be disposed between shell 201 and base-plate 203.

Figure 7:
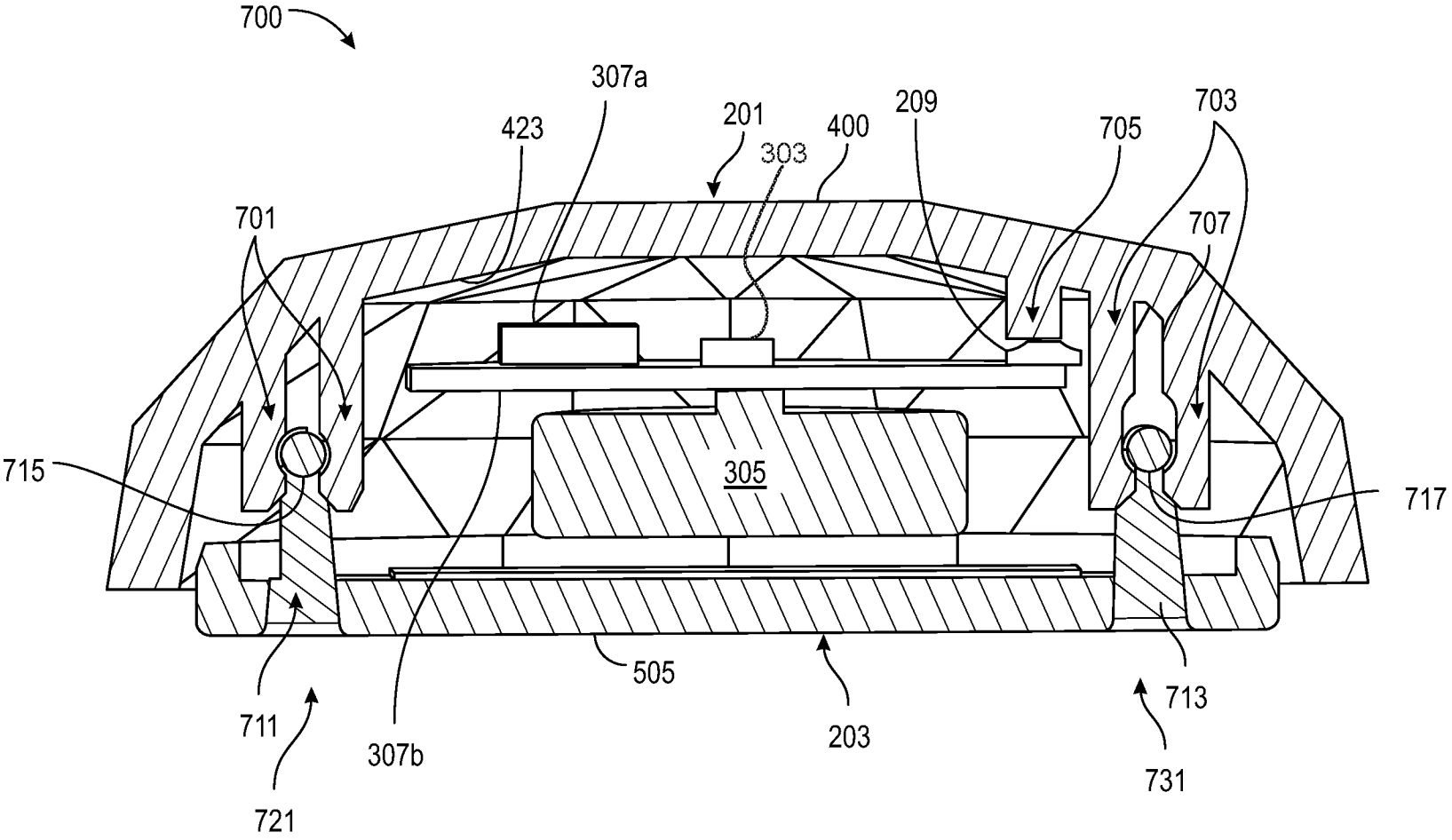
FIG. 7 may depict a cross-section through a longitude/length of an artificial-jewel-with-internal-light-source.

FIG. 7 may depict a cross-section through a longitude/length of an artificial-jewel-with-internal-light-source 700. Like artificial-jewel-with-internal-light-source 200, artificial-jewel-with-internal-light-source 700 may comprise at least one shell 201, at least one base-plate 203, and at least one electronics-assembly 301 (wherein 301 may comprise at least one light-portion 303, at least one power-source 305, and at least one integrated-circuit 307); however, artificial-jewel-with-internal-light-source 700 may have some differences, such as, but not limited to: shell 201 in artificial-jewel-with-internal-light-source 700 may have downward protruding pivot-arms 701, downward protruding up-down arms 703, and downward protruding button-push-arm 705; base-plate 203 of artificial-jewel-with-internal-light-source 700 may have upward protruding pivot-stand 711 and upward protruding stand 713; integrated-circuit 307 of artificial-jewel-with-internal-light-source 700 may be sub-divided into microcontroller 307*a* and PCB (printed circuit board) 307*b*; and button 209 of artificial-jewel-with-internal-light-source 700 may be entirely disposed between button-push-arm 705 and a portion of PCB 307*b*.

Continuing discussing FIG. 7, in some embodiments, an interior of shell 201 (e.g., inside-surface 423) may comprise downward protruding pivot-arms 701 and downward protruding up-down arms 703, and downward protruding button-push-arm 705. In some embodiments, pivot-arms 701, up-down arms 703, and button-push-arm 705 may be downward projections of shell 201 material, projecting downward predetermined distances towards base-plate 203 when artificial-jewel-with-internal-light-source 700 is assembled. In some embodiments, pivot-arms 701, up-down arms 703, and button-push-arm 705 may be fixed (static) structures of shell 201, moving only if shell 201 moves. In some embodiments, with respect to a length/longitude of artificial-jewel-with-internal-light-source 700, pivot-arms 701 and up-down arms 703 may be disposed opposite from each other on inside-surface 423 of shell 201. In some embodiments, pivot-arms 701 and up-down arms 703 may be separated from each other on shell 201 by a fixed and predetermined distance. In some embodiments, with respect to a length/longitude of artificial-jewel-with-internal-light-source 700, button-push-arm 705 may be disposed between pivot-arms 701 and up-down arms 703. In some embodiments, button-push-arm 705 may be located closer to up-down arms 703 than to pivot-arms 701.

Continuing discussing FIG. 7, in some embodiments, pivot-arms 701 may be a pair of downward protruding arms of shell 201 material, configured to receive a ball/bar 715 (of pivot-stand 711) in a pivot/hinge mechanical relationship. In some embodiments, distal portions of pivot-arms 701 may hingedly (pivotally) attach to ball/bar 715 (of pivot-stand 711) in a pivot/hinge mechanical relationship. In some embodiments, the pivot/hinge relationship between distal portions of pivot-arms 701 and ball/bar 715 (of pivot-stand 711) may form a pivot-end 721 of artificial-jewel-with-internal-light-source 700.

Continuing discussing FIG. 7, in some embodiments, up-down arms 703 may be a pair of downward protruding arms of shell 201 material, configured to receive a ball/bar 717 (of stand 713) into a pocket 707 formed at or proximate to distal ends of the pair of downward protruding arms of up-down arms 703. In some embodiments, pocket 707 may be formed around a predetermined gap between the pair of up-down arms 703. In some embodiments, pocket 707 may capture (receive) ball/bar 717 (of stand 713). In some embodiments, pocket 707 may have a predetermined and fixed length. In some embodiments, pocket 707 may travel up and down the predetermined and fixed length around ball/bar 717 (of stand 713). In some embodiments, the up and down relationship between pocket 707 and ball/bar 717 (of stand 713) may form an up-down translation end 731 of artificial-jewel-with-internal-light-source 700. In some embodiments, when a user presses down upon an exterior (exterior-surface 400) of shell 201, pocket 707 may travel down around ball/bar 717 (of stand 713), with pivot-end 721 having the pivot/hinge mechanics occurring.

Continuing discussing FIG. 7, in some embodiments, an interior side/surface of base-plate 203 (e.g., inside-surface 501) may comprise pivot-stand 711 and stand 713. In some embodiments, pivot-stand 711 and stand 713 may be protrusions of base-plate 203 material that protrude upwards (orthogonally) from base-plate 203 towards pivot-arms 701 and towards up-down arms 703, respectively, of shell 201, when artificial-jewel-with-internal-light-source 700 may be assembled. In some embodiments, pivot-stand 711 may protrude upwards away from base-plate 203 and towards pivot-arms 701, when artificial-jewel-with-internal-light-source 700 may be assembled. In some embodiments, stand 713 may protrude upwards away from base-plate 203 and towards up-down arms 703, when artificial-jewel-with-internal-light-source 700 may be assembled. In some embodiments, pivot-stand 711 and stand 713 may extend (protrude) away from base-plate 203 a fixed and predetermined distance(s). In some embodiments, pivot-stand 711 and stand 713 may fixed (static) with respect to each other, and may move only if/when base-plate 203 moves. In some embodiments, pivot-stand 711 and stand 713 may move together as one only if/when base-plate 203 moves. In some embodiments, pivot-stand 711 may be disposed opposite from stand 713 on base-plate 203. In some embodiments, pivot-stand 711 and stand 713 may be separated from each other on base-plate 203 by a fixed and predetermined distance.

Continuing discussing FIG. 7, in some embodiments, a distal portion of pivot-stand 711 may terminate in/at ball/bar 715. In some embodiments, ball/bar 715 may be a spherical, bulbous, or cylindrical shaped structure at terminal/distal end of pivot-stand 711, disposed away from base-plate 203. In some embodiments, ball/bar 715 may be configured to be received and held (capture) between the pair of pivot-arms 701 in a hinge/pivot mechanics relationship, allowing for/forming pivot-end 721 of artificial-jewel-with-internal-light-source 700.

Continuing discussing FIG. 7, in some embodiments, a distal portion of stand 713 may terminate in/at ball/bar 717. In some embodiments, ball/bar 717 may be a spherical, bulbous, or cylindrical shaped structure at terminal/distal end of stand 713, disposed away from base-plate 203. In some embodiments, ball/bar 717 may be configured to be received and held (capture) between the pair of up-down arms 703 in pocket 707 a sliding/slidable mechanics relationship, allowing for/forming up-down translation end 731 of artificial-jewel-with-internal-light-source 700.

Note, while pivot-stand 711 and stand 713 are shown protruding upwards from base-plate 203 towards shell 201 in FIG. 7; and while pivot-arms 701 and up-down arms 703 are shown protruding downwards from shell 201 towards base-plate 203 in FIG. 7; in other embodiments, this configuration may be switched, while still preserving the pivot/hinge mechanics relationship between shell 201 and base-plate 203. That is, in some embodiments, pivot-stand 711 and stand 713 may protrude downwards from shell 201 toward base-plate 203 and pivot-arms 701 and up-down arms 703 may protrude upwards from base-plate 203 towards shell 201.

Continuing discussing FIG. 7, in some embodiments, the up-down (back and forth) sliding mechanics of up-down translation end 731 of artificial-jewel-with-internal-light-source 700 between pocket 707 and ball/bar 717 may be in a substantially orthogonal (perpendicular) direction with respect to the main plane of bottom-surface 505 of base-plate 203. In some embodiments, a top of the shell 201 faces the up direction and the bottom-surface 505 of the base-plate 203 (that is disposed opposite from the top of the shell 201) faces the down direction.

Continuing discussing FIG. 7, in some embodiments, power-source 305 may be disposed above base-plate 203, when artificial-jewel-with-internal-light-source 700 is assembled. In some embodiments, power-source 305 may be disposed above inside-surface 501 of base-plate 203, when artificial-jewel-with-internal-light-source 700 is assembled. In some embodiments, power-source 305 may be in physical contact with a bottom portion of PCB 307*b*. In some embodiments, power-source 305 may be operatively connected with a bottom portion of PCB 307*b*. In some embodiments, PCB 307*b* may be in physical contact and/or operatively connected to: button 209, light-portion 303, and microcontroller 307*a*. In some embodiments, button 209, electronic-assembly 301, light-portion 303, integrated-circuit 307, microcontroller 307*a*, and PCB 307*b* may all be entirely disposed between base-plate 203 (e.g., inside-surface 501) and interior portions of shell 201 (e.g., inside-surface 423), when artificial-jewel-with-internal-light-source 700 is assembled. In some embodiments, button 209, electronic-assembly 301, light-portion 303, integrated-circuit 307, microcontroller 307*a*, and PCB 307*b* may all be entirely disposed between pivot-arms 701 and up-down arms 703, when artificial-jewel-with-internal-light-source 700 is assembled. In some embodiments, button 209, electronic-assembly 301, light-portion 303, integrated-circuit 307, microcontroller 307*a*, and PCB 307*b* may all be entirely disposed between pivot-stand 711 and stand 713, when artificial-jewel-with-internal-light-source 700 is assembled.

Continuing discussing FIG. 7, in some embodiments, button 209 may be in physical contact with a portion of PCB 307*b*. In some embodiments, button 209 may be attached to a portion of PCB 307*b*. In some embodiments, button 209 may be in physical contact with a top portion of PCB 307*b* on an opposite side of PCB 307*b* from where power-source 305 may be located. In some embodiments, button 209 may be attached to a top portion of PCB 307*b* on an opposite side of PCB 307*b* from where power-source 305 may be located. In some embodiments, button 209 may be in physical contact with a top portion of PCB 307*b* that is proximate to a distal end of PCB 307*b*. In some embodiments, button 209 may be attached to a top portion of PCB 307*b* that is proximate to a distal end of PCB 307*b*. In some embodiments, button 209 may be operatively connected to a portion of PCB 307*b*.

Continuing discussing FIG. 7, in some embodiments, a push button side of button 209 (e.g., a top side of button 209) that is disposed opposite from where button 209 is in communication with PCB 307*b*, may be in removable contact with a distal/terminal portion of button-push-arm 705; such that when a user presses/pushed upon shell 201 (e.g., presses/pushes on exterior-surface 400), then pocket 707 may travel down ball/bar 717 (towards base-plate 203), a distal/terminal portion of pivot-arms 701 may pivot around/on ball/bar 715, and the distal/terminal portion of button-push-arm 705 may press/push sufficiently hard against button 209 to engage/activate button 209. In some embodiments, in this manner the user may control and/or operate the given artificial-jewel-with-internal-light-source 700. In some embodiments, engagement/activation of button 209 may turn light-portion 303 on or off. In some embodiments, engagement/activation of button 209 may turn microcontroller 307*a* on or off, wherein microcontroller 307*a* may in turn control light-portion 303.

Continuing discussing FIG. 7, in some embodiments, button 209 and microcontroller 307*a* may be disposed opposite from each other on PCB 307*b*. In some embodiments, light-portion 303 may be disposed between microcontroller 307*a* and button 209 on PCB 307*b*.

Continuing discussing FIG. 7, in some embodiments, light-portion 303 may be in physical contact with a portion of PCB 307*b*. In some embodiments, light-portion 303 may be attached to a portion of PCB 307*b*. In some embodiments, light-portion 303 may be in physical contact with a top portion of PCB 307*b* on an opposite side of PCB 307*b* from where power-source 305 may be located. In some embodiments, light-portion 303 may be attached to a top portion of PCB 307*b* on an opposite side of PCB 307*b* from where power-source 305 may be located. In some embodiments, light-portion 303 may be in physical contact with a top portion of PCB 307*b* that is about in a middle of PCB 307*b*. In some embodiments, light-portion 303 may be attached to top portion of PCB 307*b* that is about in a middle of PCB 307*b*. In some embodiments, light-portion 303 may be operatively connected to a portion of PCB 307*b*. In some embodiments, light emitting portions of light-portion 303 may be directed/oriented to/facing upper inside-surfaces 423 of shell 201. In some embodiments, light-portion 303 may comprise one or more LEDs (light emitting diodes) (which may generate light of different colors).

In some embodiments, microcontroller 307*a* and/or PCB 307*b* may comprise one or more processors (e.g., for executing code/program instructions) and/or one or more memory (e.g., for non-transitory storage of the code/program instructions, user preferences/settings, and/or the like).

In some embodiments, artificial-jewel-with-internal-light-source 200 and/or 700 may comprise: shell 201, base-plate 203, and electronics-assembly 301. In some embodiments, shell 201 may have exterior-surface 400 that may be shaped and sized to mimic a crown of a predetermined type of cut gemstone, such as, but not limited to, a marquise type (other types are expressly contemplated). In some embodiments, shell 201 may comprise base 419 around a bottom edge of shell 201. In some embodiments, exterior-surface 400 of shell 201 may be faceted. In some embodiments, at least a portion of shell 201 may be optically transparent. In some embodiments, base-plate 203 may be to base 419 of shell 201. In some embodiments, base-plate 203 may have bottom-surface 505 that may face away from shell 201. In some embodiments, at least a portion of bottom-surface 505 of base-plate 201 may comprise sticky-adhesive-layer 211 that may be configured to removably stick to the region of human skin. In some embodiments, electronics-assembly 301 may comprise at least one light-portion 303 that may be configured to emit light. In some embodiments, part (at least part of) of electronics-assembly 301 may be disposed between inside-surface 423 of shell 201 and an inside-surface 501 of base-plate 203. In some embodiments, inside-surface 201 of base-plate 203 may be an opposing surface to bottom-surface 505 of base-plate 203.

In some embodiments, the electronics-assembly 301 may include a push button 209 that may extend out beyond a bottom of base-plate 203. In some embodiments, a distal portion of the push button 209 may physically touch the region of human skin. User (e.g., a wearer) control of light emission of artificial-jewel-with-internal-light-source 200 may occur by the user pressing shell 201 towards the region of the human skin that the artificial-jewel-with-internal-light-source 200 may be removably attached to, which in turn may cause engagement of this push button 209 that may be touching the region of the human skin.

In some embodiments, at least an exterior/bottom portion of base-plate 203 may be configured to attach to (removably so in some embodiments) some predetermined substrate. In some embodiments, this predetermined substrate may be selected from one or more of: a region of human skin; a region of face human skin; a region of a tangible object; a region of an inanimate object; a region of plastic; a region of glass; a region of metal; a region of wood; a region of ceramic; a region of a composite; a region of a laminate; a region of fabric; a region of clothing/apparel/garment; a region of footwear; a region of a harness; a region of a backpack; a region of a purse; a region of a wallet; a region of fanny pack; a region of a collar; a region of a leash; a region of a crown/tiara; a region of jewelry; a region of a mask; a region of a wall; a region of a ceiling; a region of a painted surface; a region of a toy; a region of a tooth; a region of substantially keratin protein; a region of a fingernail; a region of a toenail; a region of hair; a region of human hair; a region of a hair accessory; combinations thereof, and/or the like. In some embodiments, a means to accomplish attachment of at least an exterior/bottom portion of base-plate 203 to the predetermined substrate may be selected from one or more of: sticky adhesive layer 211, glues, adhesives, press fits, friction fits, snap fits, mechanical fasteners, zippers, snaps, buttons, ties, screws, bolts, nails, rivets, welding, ultrasonic welding, solvent bonding/welding, Ziploc sealers or the like, Velcro or the like (e.g., plurality of hooks on one surface and a plurality of loops on a complimentary surface), combinations thereof, and/or the like.

In some embodiments, a plurality of the artificial-jewel-with-internal-light-source 200 and/or 700 and/or a plurality of the shells 201 may be arranged into a predetermined configuration, attached to the predetermined substrate. In some embodiments, the predetermined configuration may mimic and/or may be substantially similar in overall appearance to one or more of: a logo; a work of art; a mascot; a sport's team logo; a sport's team mascot; a trademark; a brand; a meme; a symbol; a character; a word; a number; a constellation; a solar system; a star; a galaxy; a planet; a moon; a comet; an asteroid; an article associated with a given character; a costume; a portion of a costume; portions thereof; combinations thereof; and/or the like. For such applications, a shape of a given shell 201 may be modified accordingly.

For example, and without limiting the scope of the present invention, in some embodiments, a given artificial-jewel-with-internal-light-source 200 and/or 700, a plurality of the artificial-jewel-with-internal-light-source 200, a shell 201, and/or a plurality of shells 201 may be configured to substantially mimic a look of the fictional "Arc Reactor" of in the chest of fictional character "Iron Man"; and could be removably attached to a region of human skin on a human chest; and/or could be attached to an article of clothing (such as, but not limited to, a shirt, a tank top, a jacket, a blouse, a dress, a skirt, a vest, a hat, pants, shorts, overalls, coveralls, gloves, mittens, scarves, a backpack, a purse, a handbag, shoes, boots, sandals, footwear, combinations thereof, and/or the like).

For example, and without limiting the scope of the present invention, in some embodiments, a given artificial-jewel-with-internal-light-source 200 and/or 700 and/or a plurality of the artificial-jewel-with-internal-light-source 200 and/or 700 may be attached to hair, hair accessories, clothing accessories, beauty accessories, combinations thereof, and/or the like.

For example, and without limiting the scope of the present invention, in some embodiments, a given artificial-jewel-with-internal-light-source 200 and/or 700 and/or a plurality of the artificial-jewel-with-internal-light-source 200 and/or 700 may be used as decals for/on furniture, walls, and/or for ceilings.

Various embodiments, of artificial jewels with internal light sources for removable attachment to a region of human skin have been described. The foregoing description of the various embodiments, some of which may be exemplary, of the invention has been presented for the purposes of illustration and disclosure. It is not intended to be exhaustive or to limit the invention to the precise form disclosed. Many modifications and variations are possible in light of the above teaching without departing from the spirit of the invention.

While the invention has been described in connection with what is presently considered to be the most practical and at least some preferred embodiments, it is to be understood that the invention is not to be limited to the disclosed embodiments, but on the contrary, is intended to cover various modifications and equivalent arrangements included within the spirit and scope of the appended claims.

What is claimed is:

1. An artificial-jewel-with-internal-light-source configured for removable attachment to a region of human skin, wherein the artificial-jewel-with-internal-light-source comprises:

a shell comprising:

an exterior-surface that is shaped and sized to mimic a crown of a predetermined type of cut gemstone, an inside-surface that is disposed opposite from the exterior-surface, a first arm that protrudes from the inside-surface and into an interior of the shell, a second arm that protrudes from the inside-surface and into the interior of the shell, a bottom edge that runs around a bottom periphery of the shell, wherein the bottom edge circumscribes an opening to the interior of the shell;

a base-plate that forms a bottom of the artificial-jewel-with-internal-light-source, wherein a periphery of the base-plate fits within the opening, wherein the base-plate comprises:

a first complimentary arm that protrudes from the base-plate into the interior, wherein the first complimentary arm is pivotally attached to the first arm, a second complimentary arm that protrudes from the base-plate into the interior, wherein the second complimentary arm is slidingly attached to the second arm, such that one end of the base-plate, a pivot-end, is pivotable with respect to the shell and an opposing end of the base-plate, an up-down translation end, is slidingly translatable with respect to the shell, a bottom-surface, wherein at least a portion of the bottom-surface of the base-plate comprises a sticky-adhesive-layer that is configured to removably stick to the region of human skin; and an electronics-assembly, wherein the electronics-assembly comprises at least one light-portion configured to emit light, wherein part of the electronics-assembly is disposed between the inside-surface of the shell and an interior-surface of the base-plate, wherein the interior-surface of the base-plate is an opposing surface to the bottom-surface of the base-plate.

2. The artificial-jewel-with-internal-light-source according to claim 1, wherein the electronics-assembly comprises at least one push button that is operatively linked to the at least one light-portion for turning the at least one light-portion on and off.

3. The artificial-jewel-with-internal-light-source according to claim 1, wherein the electronics-assembly comprises at least one push button that is engageable in an up direction and in a down direction, wherein a top of the shell faces the up direction and the bottom-surface of the base-plate faces the down direction, wherein when the sticky-adhesive-layer is removably stuck to the region of human skin, actuating the at least one push button does not impart a shear stress to the artificial-jewel-with-internal-light-source.

4. The artificial-jewel-with-internal-light-source according to claim 1, wherein the electronics-assembly is disposed between the first arm and the second arm.

5. The artificial-jewel-with-internal-light-source according to claim 1, wherein the shell comprises a third arm that protrudes from the inside-surface and into the interior of the shell; wherein the electronics-assembly comprises a push button that is operatively linked with the at least one light portion; wherein a distal portion of the third arm is in physical communication with a top surface of the push button.

6. The artificial-jewel-with-internal-light-source according to claim 1, wherein the electronics-assembly comprises at least one power-source that is operatively linked to the at least one light-portion, wherein the at least one power-source electrically powers the at least one light-portion.

7. The artificial-jewel-with-internal-light-source according to claim 1, wherein the electronics-assembly has no wires protruding from the electronics-assembly.

8. The artificial-jewel-with-internal-light-source according to claim 1, wherein a light emitting portion of the at least one light-portion is located below a top of the shell and above a center of the interior-surface of the base-plate.

9. The artificial-jewel-with-internal-light-source according to claim 5, wherein the third arm is disposed between the first arm and the second arm.

10. The artificial-jewel-with-internal-light-source according to claim 9, wherein the third arm is located closer to the second arm than to the first arm.

11. The artificial-jewel-with-internal-light-source according to claim 1, wherein the exterior-surface of the shell comprises at least one facet.

12. The artificial-jewel-with-internal-light-source according to claim 1, wherein at least a portion of the shell is substantially optically transparent with respect to wavelengths of light visible to a naked human eye.

13. The artificial-jewel-with-internal-light-source according to claim 1, wherein the shell has a thickness between the exterior-surface of the shell and the inside-surface of the shell.

14. The artificial-jewel-with-internal-light-source according to claim 1, wherein the exterior-surface of the shell is convex and the inside-surface of the shell is concave such that when the base-plate is attached to the shell, a volume is defined between the inside-surface of the shell and the interior-surface of the base-plate, wherein the electronics-assembly occupies at least a portion of this volume.

15. The artificial-jewel-with-internal-light-source according to claim 1, wherein when the shell is viewed from a side, the bottom edge of the shell is flat.

16. The artificial-jewel-with-internal-light-source according to claim 1, wherein the predetermined type of cut gemstone is selected from: a marquise type, a round type, a princess type, an oval type, a heart type, an emerald type, a pear type, an asscher type, a cushion type, a trilliant type, a baguette type, a radiant type, a square type, an octagon type, a tapered baguette type, an antique cushion type, a briolette type, a cabochon type, a drop type, a ball type, a rose type, a star type, a hexagon type, a pentagon type, or a triangle type.

17. The artificial-jewel-with-internal-light-source according to claim 1, wherein the bottom-surface of the base-plate is a substantially flat and planar member.

18. The artificial-jewel-with-internal-light-source according to claim 5, wherein the push button is configured to be actuated by a user pressing against the exterior-surface of the shell, wherein that pressing is directly communicated through the third arm and to the top surface of the button causing the push button to depress and actuate.

19. The artificial-jewel-with-internal-light-source according to claim 1, wherein the sliding translation between the second arm and the second complimentary arm is facilitated by a distal end of the second complimentary arm being confined within a pocket of the second arm.

20. The artificial-jewel-with-internal-light-source according to claim 1, wherein the sticky-adhesive-layer is substantially hypoallergenic.

21. An artificial-jewel-with-internal-light-source configured for removable attachment to a region of human skin, wherein the artificial-jewel-with-internal-light-source comprises:

a shell comprising:

an exterior-surface that is shaped and sized to mimic a crown of a predetermined type of cut gemstone, an inside-surface that is disposed opposite of the exterior-surface, wherein the exterior-surface of the shell is convex and the inside-surface of the shell is concave, and a base around a bottom edge of the shell;

a base-plate with a hole that is attached to the base of the shell, wherein the base-plate has a bottom-surface, wherein at least a portion of the bottom-surface of the base-plate comprises a sticky-adhesive-layer that is configured to removably stick to the region of human skin; and an electronics-assembly comprising:

at least one light-portion configured to emit light, at least one push button that has a portion that is extendable through the hole in the base-plate, and at least one power source, wherein at least one power source is operatively linked to the at least one light-portion and to the at least one push button;

wherein a volume is defined between the inside-surface of the shell and an interior-surface of the base-plate, wherein the electronics-assembly, except for the portion of the at least one push button that is extendable through the hole in the base-plate, is located within the volume, wherein the interior-surface of the base-plate is disposed opposite of the bottom-surface of the base-plate;

wherein the at least one push button is engageable in an up direction and in a down direction, wherein a top of the shell faces the up direction and the bottom-surface of the base-plate faces the down direction, wherein when the sticky-adhesive-layer is removably stuck to the region of human skin a distal portion of the at least one push button that is furthest away from the top of the shell is physically contacting the region of human skin, such that actuating the at least one push button occurs by a user pressing against the top of the shell towards the region of human skin.

* * * * *